US006065829A

United States Patent [19]

Ruiz et al.

[11] Patent Number: 6,065,829

[45] Date of Patent: May 23, 2000

[54] PERIODIC INK REPLENISHMENT STATION WITH REMOVABLE OFF-CARRIAGE INK SUPPLY CONTAINERS

[75] Inventors: Felix Ruiz, Barcelona, Spain; Robert Giles, Escondido; Mark E. Young, Santa Rosa, both of Calif.; Elizabeth Zapata, Barcelona; Rosa Calatayud, Sant Cugat, both of Spain

[73] Assignee: Hewlett-Packard Company, Palo Alto, Calif.

[21] Appl. No.: 09/032,225

[22] Filed: Feb. 27, 1998

Related U.S. Application Data

[63] Continuation-in-part of application No. 08/805,860, Mar. 3, 1997.

[51] Int. Cl.[7] ..... B41J 2/175

[52] U.S. Cl. ..... 347/85

[58] Field of Search ..... 347/7, 85, 86, 347/87, 29, 30

[56] References Cited

U.S. PATENT DOCUMENTS

| | | | |
|---|---|---|---|
| 3,930,258 | 12/1975 | Dick et al. | 347/7 |
| 4,223,323 | 9/1980 | Bader et al. | 347/85 |
| 4,412,232 | 10/1983 | Weber et al. | 347/86 |
| 4,475,116 | 10/1984 | Sicking et al. | 347/86 |
| 4,500,895 | 2/1985 | Buck et al. | 347/87 |
| 4,714,937 | 12/1987 | Kaplinsky | 347/86 |
| 4,831,389 | 5/1989 | Chan | 347/86 |
| 4,833,491 | 5/1989 | Rezanka | 347/93 |
| 4,929,963 | 5/1990 | Balazar | 347/87 |
| 4,959,667 | 9/1990 | Kaplinsky | 347/87 |
| 4,967,207 | 10/1990 | Ruder | 347/7 |
| 4,968,998 | 11/1990 | Allen | 347/7 |
| 4,970,528 | 11/1990 | Beaufort et al. | 346/25 |
| 5,121,132 | 6/1992 | Pan et al. | 347/87 |
| 5,126,767 | 6/1992 | Asai | 347/86 |
| 5,136,305 | 8/1992 | Ims | 347/7 |
| 5,280,300 | 1/1994 | Fong et al. | 347/87 |
| 5,329,294 | 7/1994 | Ontawar et al. | 397/87 |
| 5,359,353 | 10/1994 | Hunt et al. | 347/86 |
| 5,367,320 | 11/1994 | Erickson | 347/7 |
| 5,369,429 | 11/1994 | Erickson | 347/7 |
| 5,631,681 | 5/1997 | Klaus et al. | 347/85 |
| 5,650,811 | 7/1997 | Seccombe et al. | 347/85 |

FOREIGN PATENT DOCUMENTS

| | | |
|---|---|---|
| 0 237 787 A3 | 2/1987 | European Pat. Off. . |
| 0 519 664 A2 | 6/1992 | European Pat. Off. . |
| 0536980 A2 | 4/1993 | European Pat. Off. . |
| 93 00 133 U | 1/1993 | Germany . |
| 61-12347 | 1/1986 | Japan . |

OTHER PUBLICATIONS

Patent Abstracts of Japan, published by the European Patent Office, Publication No.: 60248355, Publication Date: Sep. 12, 1985.

*Primary Examiner*—N. Le
*Assistant Examiner*—Anh T. N. Vo

[57] ABSTRACT

An inkjet printing system with an automated ink replenishment station for replenishing printhead ink reservoirs mounted in a carriage from removable off-carriage ink supply containers. The system includes a printer frame and a scanning carriage mounted on the frame for traversing back and forth along a scan axis through a print zone. At least one printhead is mounted on the carriage, and has a sealed printhead ink reservoir and a normally closed inlet valve in fluid communication with the printhead ink reservoir for receiving ink. The ink replenishment station is located on the frame at one end of the scan axis, and includes an ink supply. A normally closed supply valve is provided at the ink replenishment station in communication with the ink supply capable of periodic connection to said inlet valve. With the carriage positioned at the replenishment station, an automated motorized mechanism moves the supply valve into engagement with the inlet valve to provide a fluid path for ink to flow from the ink supply to the printhead ink reservoir without manual intervention.

24 Claims, 25 Drawing Sheets

FIG. 6
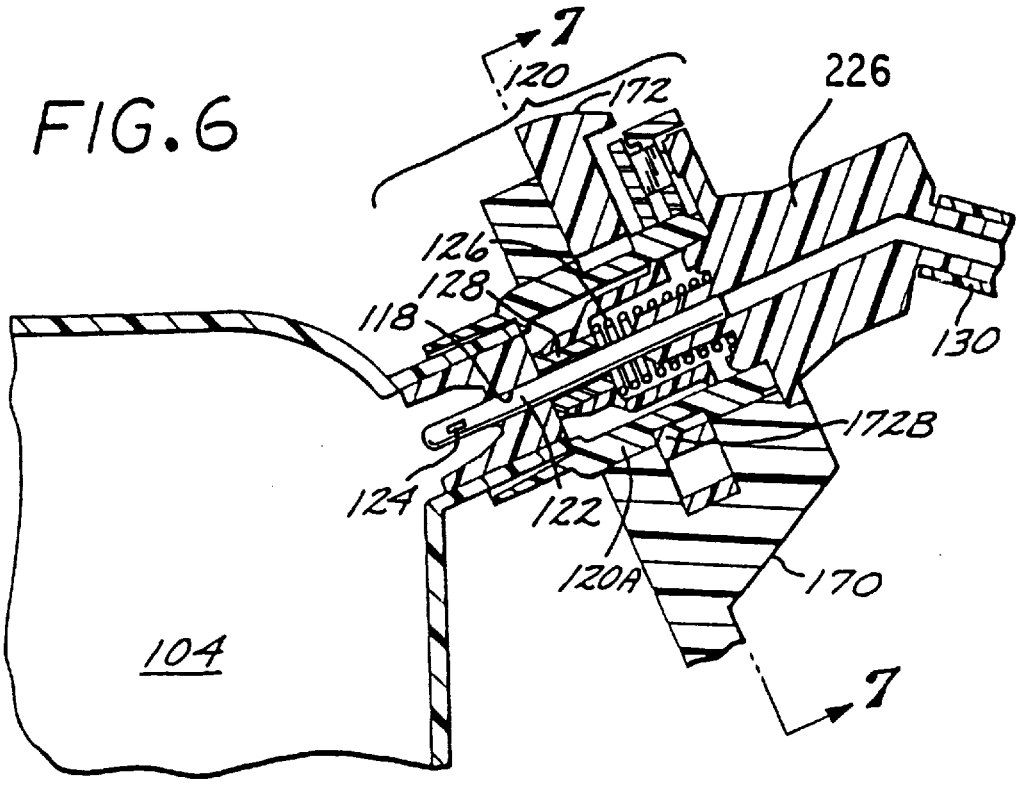
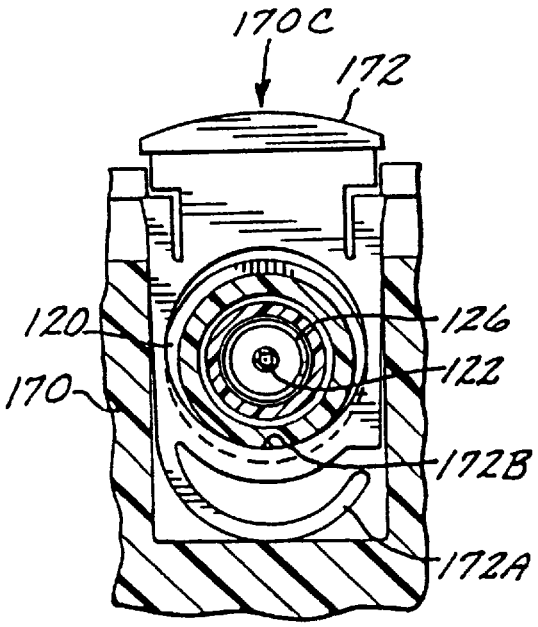
FIG. 7
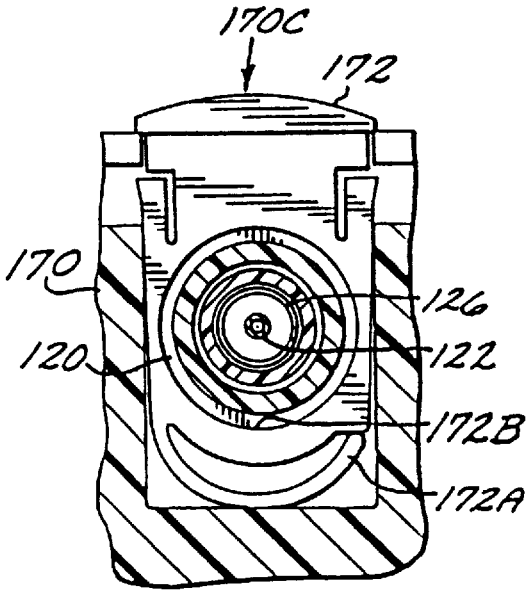
FIG. 8

PERIODIC INK REPLENISHMENT STATION WITH REMOVABLE OFF-CARRIAGE INK SUPPLY CONTAINERS

The present application is a continuation-in-part application of application U.S. Ser. No. 08/805,860 filed Mar. 3, 1997 by Erich Coiner and Rosa Calatayud entitled SPACE-EFFICIENT ENCLOSURE SHAPE FOR NESTING TOGETHER A PLURALITY OF REPLACEABLE INK SUPPLY BAGS now U.S. Pat. No. 5,745,137 which application is incorporated herein by reference.

CROSS-REFERENCE TO RELATED APPLICATIONS

A previously filed co-pending commonly assigned application related to this application is Ser. No. 08/454,975 filed May 31, 1995 by Joseph E.Scheffelin et al. (The "'975 application") entitled CONTINUOU.S. REFILL OF SPRING BAG RESERVOIR IN AN INK-JET SWATH PRINTER/PLOTTER now U.S. Pat. No. 5,745,137, which is incorporated herein by reference.

Other more recent co-pending commonly assigned related applications are U.S. Ser. No. 08/726,587 filed Oct. 7, 1996 by Max S. Gunther et al. entitled INKJET CARTRIDGE FILL PORT ADAPTOR now U.S. Pat. No. 5,874,976; U.S. Ser. No. 08/810,485 filed Mar. 3, 1997 by Rick Becker et al. entitled INKJET PRINTING WITH REPLACEABLE SET OF INK-RELATED COMPONENTS etc.; U.S. Ser. No. 08/805,859 filed Mar. 3, 1997 by Elizabeth Zapata et al. entitled REPLACEABLE INK SUPPLY MODULE (BAG/BOX/TUBE/VALVE) etc.; U.S. Ser. No. 08/810,840 filed Mar. 3, 1997 by Max S. Gunther et al. entitled PRINTING SYSTEM WITH SINGLE ON/OFF CONTROL VALVE etc. now U.S. Pat. No. 5,929,883; U.S. Ser. No. 08/805,861 filed Mar. 3, 1997 by Ignacio Olazabal et al. entitled APPARATUS FOR PERIODIC AUTOMATED CONNECTION OF INK SUPPLY VALVES etc.; U.S. Ser. No. 08/806,749 filed Mar. 3, 1997 by Mark Young et al. entitled VARIABLE PRESSURE CONTROL FOR INK REPLENISHMENT etc. now U.S. Pat. No. 5,992,985; and U.S. Ser. No. 09/032,376 filed Feb. 27, 1998 by Rosa Calatayud et al. entitled ACTIVE CONTROL OF VERTICAL POSITION OF AN OFF-CARRIAGE INK SUPPLY, all of which are incorporated herein by reference.

This invention relates to ink-jet printers/plotters, and more particularly to techniques in varying off-axis ink cartridge reservoir height to decrease on-carriage print cartridge refill time, ensure ink refill volume reliability and set print cartridge vacuum pressure.

BACKGROUND OF THE INVENTION

A printing system is described in the commonly assigned patent application entitled "CONTINUOUS REFILL OF SPRING BAG RESERVOIR IN AN INK-JET SWATH PRINTER/PLOTTER" which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printer/plotters has been developed, wherein the on-carriage spring reservoir of the print cartridge is only intermittently connected to the off-carriage reservoir to "take a gulp" and is then disconnected from the off-carriage reservoir. No tubing permanently connecting the on-carriage and off-carriage elements is needed. The above-referenced applications describe certain features of this new ink delivery system.

BRIEF SUMMARY OF THE INVENTION

This invention optimizes the performance of this new off-carriage, take-a-gulp in delivery system. In this type of IDS, a pen cartridge that uses an internal spring to provide vacuum pressure is intermittently connected to an ink reservoir located off the scanning carriage axis. Starting with a "full" pen cartridge, the printer will print a variety of plots while monitoring the amount of ink used. After a specified amount of ink has been dispensed, the pen carriage is moved to a refill station for ink replenishment. In the refill station, a valve is engaged into the pen, thus connecting the ink reservoir to pen cartridge and opening a path for ink to flow freely. Using only the vacuum pressure present in the pen cartridge, ink is "pulled" into the pen from the reservoir.

A plurality of ink supply bags for an inkjet printer are each enclosed in a separate protective enclosure having a front opening for an end-connect outlet. The cross-section of the enclosure is a diamond shaped parallelogram so that when several of the enclosures are placed side-by-side, overlapping occurs between adjacent enclosures. This provides a decreased overall width for an ink supply station an the printer while at the same time still allowing use of an elongated flattened collapsible bag inside each enclosure. The Ink supply station includes a front-access storage shelf having separate divider walls which together with a floor define a series of slots which coincide with the outer shape of the enclosures for removably receiving and protectively holding the enclosures together on the printer in separated nesting relationship.

A printing system which provides active control of the vertical position of an off-carriage ink supply. The system includes an ink-jet print cartridge having an ink reservoir for holding a supply of liquid ink, and an ink replenishment port. A carriage holds the print cartridge, and a carriage scanning apparatus drives the carriage along a carriage scan axis. The system further includes an off-carriage ink supply which is connectable via a fluid path to the ink replenishment port of the cartridge. An elevator apparatus actively raises or lowers the off-carriage ink supply in response to drive commands to position the off-carriage ink supply at a plurality of different elevations relative to a vertical position of the print cartridge to supply ink to the ink replenishment port via the fluid path.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6 and showing structure of the needle valve and locking structure for locking the valve in the refill socket at the refill station.

FIG. 8 is a cross-sectional view similar to FIG. 7, showing the lock in a released position.

DETAILED DESCRIPTION OF THE PREFERRED EMBODIMENT

Figure 1:
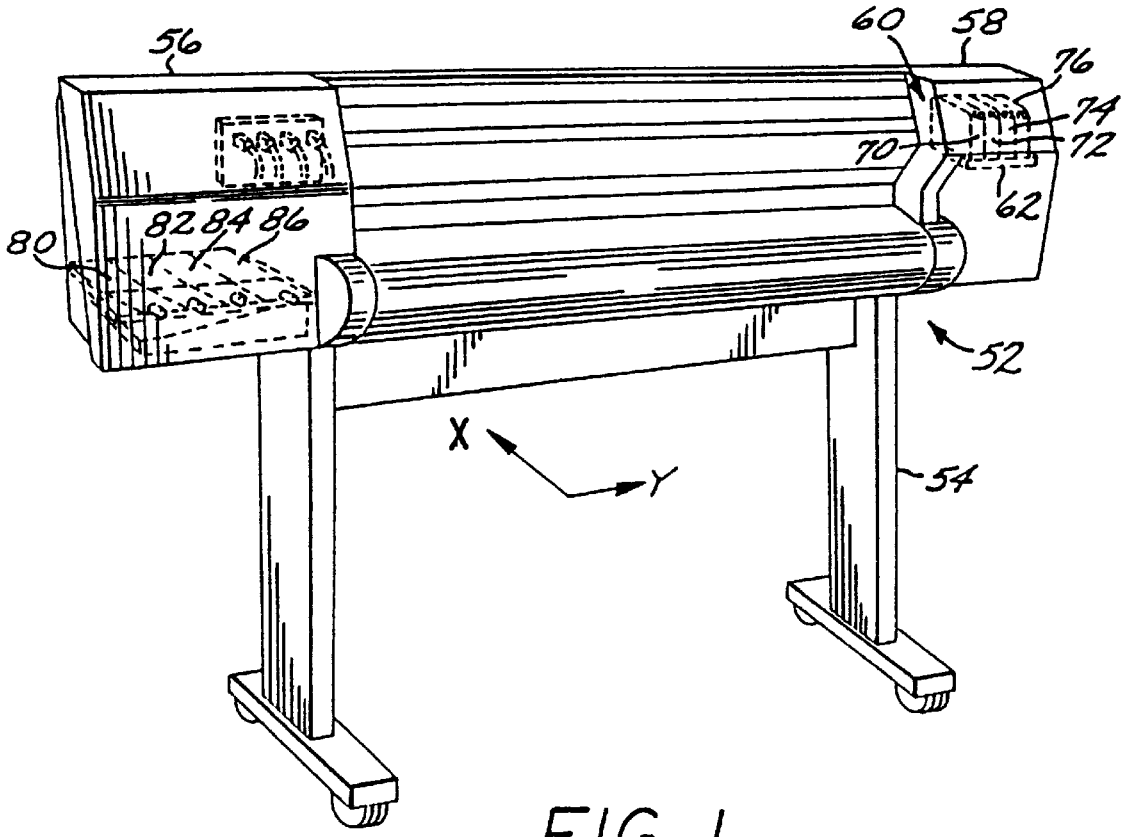
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage bar, shown in phantom under cover 56. A print medium ouch as paper is positioned along a vertical or media axis by a media axis drive mechanism (not shown). As is common in the art, the media drive axis is denoted as the 'x' axis and the carriage scan is denoted as the 'y' axis.

Figure 3:
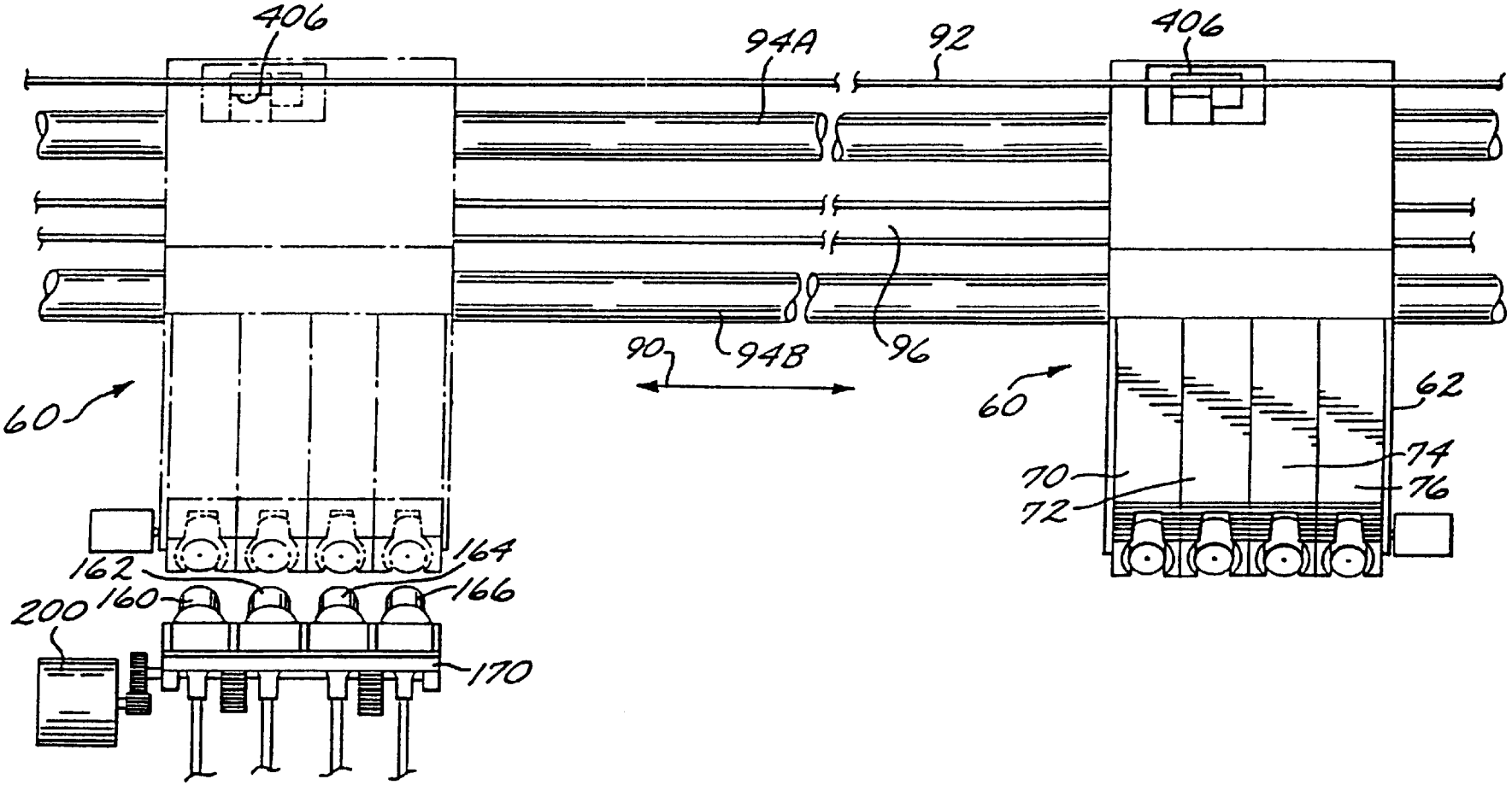
FIG. 3 is a top view showing the printer carriage and refill station.

FIG. 3 is a top view diagrammatic depiction of the carriage assembly 60, and the refill station. The carriage assembly 60 glides on slider rods 94A, 94B. The position of the carriage assembly 60 along a horizontal or carriage scan axis is determined by a carriage positioning mechanism with respect to an encoder strip 92. The carriage positioning mechanism includes a carriage position motor 404 (FIG. 15) which drives a belt 96 attached to the carriage assembly. The position of the carriage assembly along the scan axis is determined precisely by the use of the encoder strip. An optical encoder 406 (FIG. 15) is disposed on the carriage assembly and provides carriage position signals which are utilized to achieve optimal image registration and precise carriage positioning. Additional details of a suitable carriage positioning apparatus are given in the above-referenced '975 application.

The printer 50 has tour ink-jet print cartridges 70, 72, 74, and 76 that store ink of different colors, e.g., black, yellow, magenta and cyan ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear sliders 92A, 92B. The cartridges are secured in a closely packed arrangement, and may each be selectively reed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in tho cartridge compartments facing the print medium.

As mentioned above, full color printing and plotting requires that the colors from the individual cartridge be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a head cleaner. The ink reservoir includes a bag holding 350 ml of ink, with a short tube and refill valve attached. Details of a ink reservoir bag structure suitable for the purpose are given in co-pending application Ser. No. 08/805,806, filed Mar. 3, 1997 SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a refill arm 170, also behind the left door, as will be described below. The print cartridge in this exemplary embodiment includes a 300-nozzle, 600 dpi printhead, with an orifice through which it is refilled. The head cleaner includes a spittoon for catching ink used when servicing and calibrating the, printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the came order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below he threshold and thus a print should never be interrupted for refilling (except when doing a long-axis print that uses more than 5 ccs of ink of any color).

Figure 4:
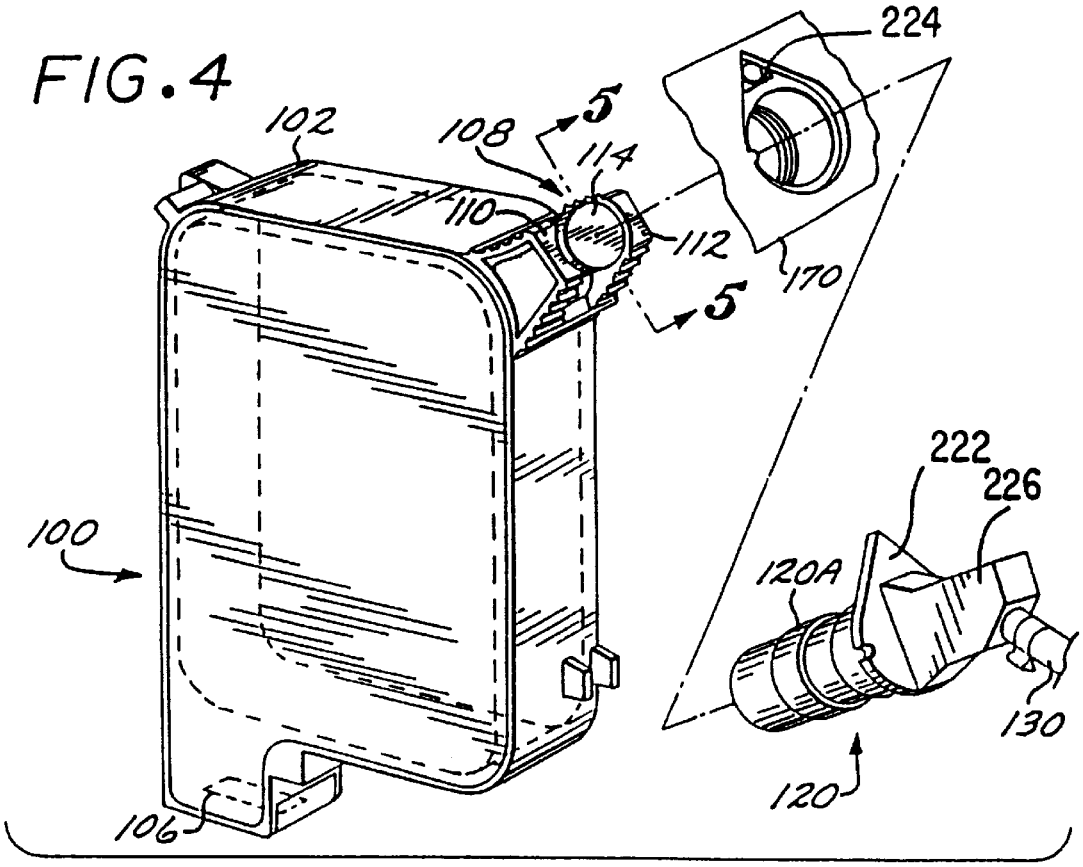
FIG. 4 is an isometric view of an ink-jet print cartridge usable in the system of FIG. 1, with a refill platform housing portion, a needle valve, and supply tube in exploded view.
Figure 5:
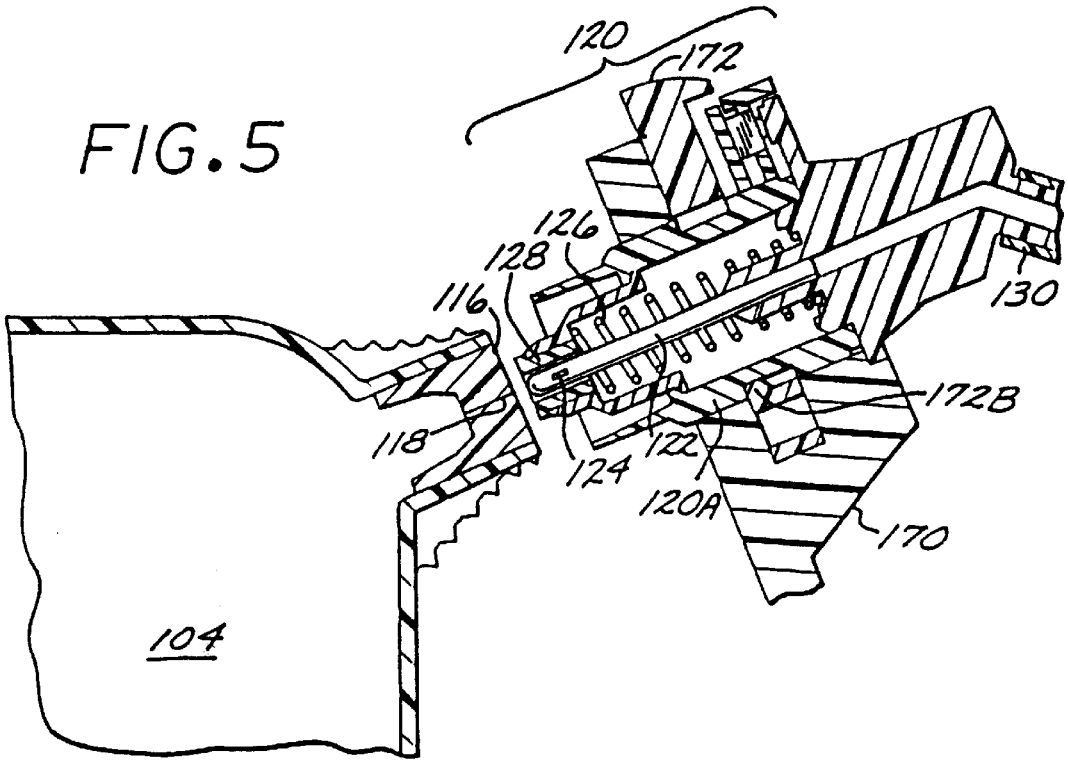
FIG. 5 is a cross-sectional view taken along line 5—5 of FIG. 4, showing the valve structure in a disengaged position relative to a refill port on the print cartridge.
Figure 9:
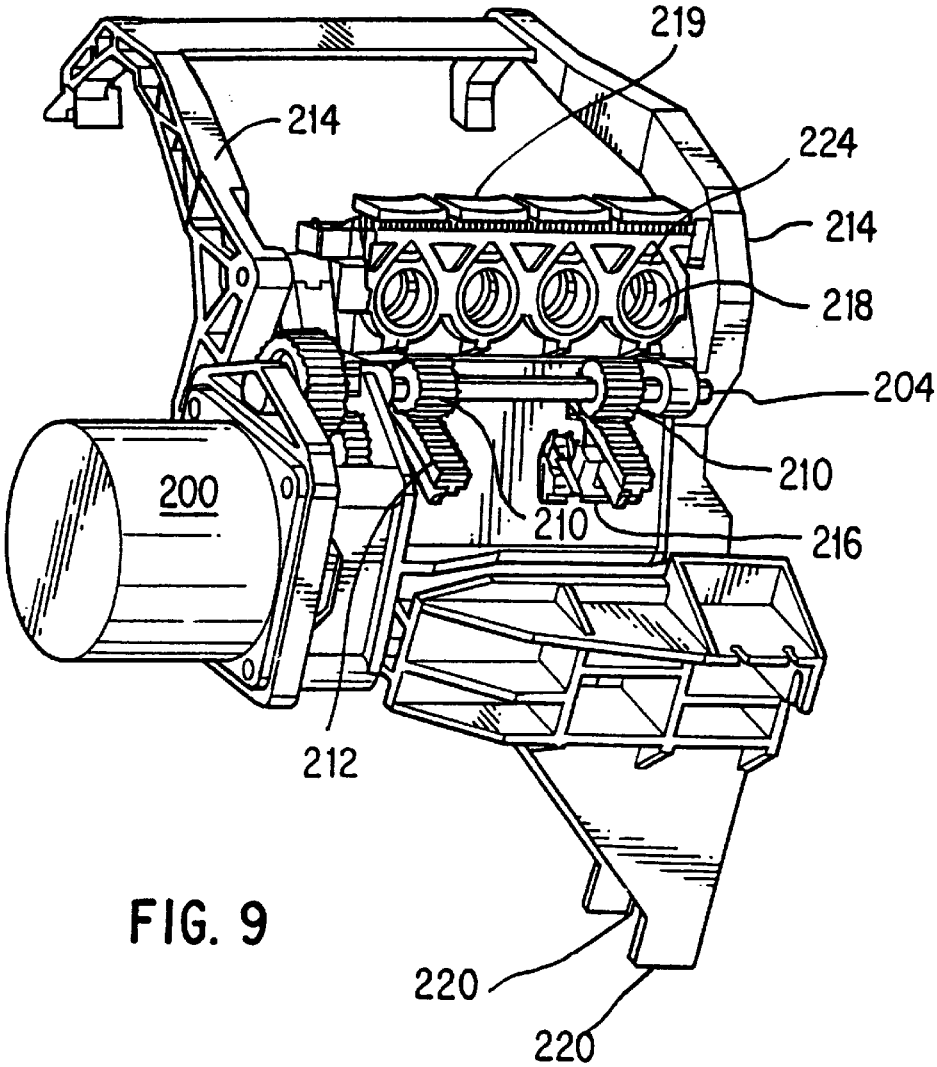
FIG. 9 is an enlarged view showing the mechanism for moving the valve structure, without any valves mounted thereon.

The '975 application describes a negative pressure, spring-bag print cartridge which is adapted for continuous refilling. FIGS. 4–6 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 70–76 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation removal from a print carriage within an ink-jet printer. The grip is formed on an external surface of the housing.

FIGS. 5–8 show additional detail of the grip 108. The grip includes two connectors 110, 112 on opposing sides of a cylindrical port 114 which communicates with the reservoir 104, The port is sealed by a septum 116 formed of an elastomeric material. The septum 116 has a small openings 118 formed therein. The grip with its port 114 is designed to intermittently engage with a needle valve structure 120 connected via a tube 132 to an off-carriage ink reservoir such au one of the reservoirs 80–86 of the system of FIG. 1. FIG. 5 shows the valve structure 120 adjacent but not engaged with the port 116. FIG. 6 shows the valve structure 120 fully engaged with the port. As shown in FIG. 6, the structure 120 includes hollow needle 122 with a closed distal end, but with a plurality of openings 124 formed therein adjacent the end. A sliding valve collar 128 tightly fits about the needle, and is biased by a spring 126 to a valve closed position shown in FIG. 5. When the structure 120 is forced against the port 116, the collar is pressed up the length of the needle, allowing the needle tip to slid into the port opening 116, as shown in FIG. 6. In this position, ink can flow through the needle openings 124 between the reservoir 104 and the tube 130. Thus, with the cartridge 100 connected to an off-carriage ink reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the collar 128. The opening 118 will close as well due to the elasticity of the material 116, thereby providing a self-dealing refill port for the print cartridge.

FIGS. 4–8 illustrate a locking structure 172 for releasably locking the valve 120 into the refill arm 170 at socket 174. The structure 172 has locking surfaces 172B (FIG. 5) which engage against the outer housing of the valve body 120A. The structure is biased into the lock position by integral spring member 172A (FIGS. 7 and 8). By exerting force on structure 170 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 each comprise a single chamber body that utilizes a negative pressure spring-bag ink delivery system, more particularly described in the '975 application.

Figure 2:
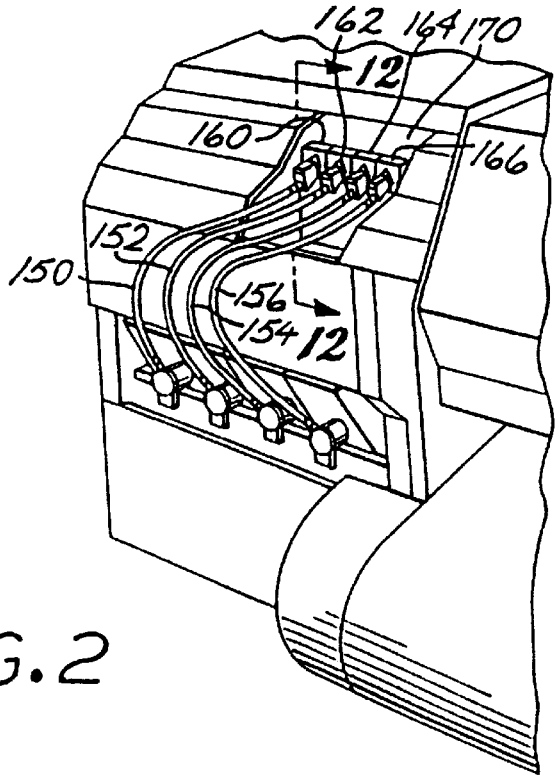
FIG. 2 is an enlarged view of a portion of the system of FIG. 1, showing the refill station.

In the exemplary system of FIG. 1, the refill platform 150 is in the left housing 56 of the printer 50 an shown in FIG. 2. The four off-carriage ink reservoirs 80–86 are supported on the platform 150. short flexible tubes 150, 152, 154 and 156 connect between ports 80A–86A of corresponding reservoirs 80–86 and needle valve structures 160, 162, 164 and 166 supported at a refill station housing 170. These needle valve structures each correspond to the valve structure 120 of FIGS. 4–8.

The refill platform 150 in an elevator that holds the four reservoirs and can be moved up and down.

Figure 13:
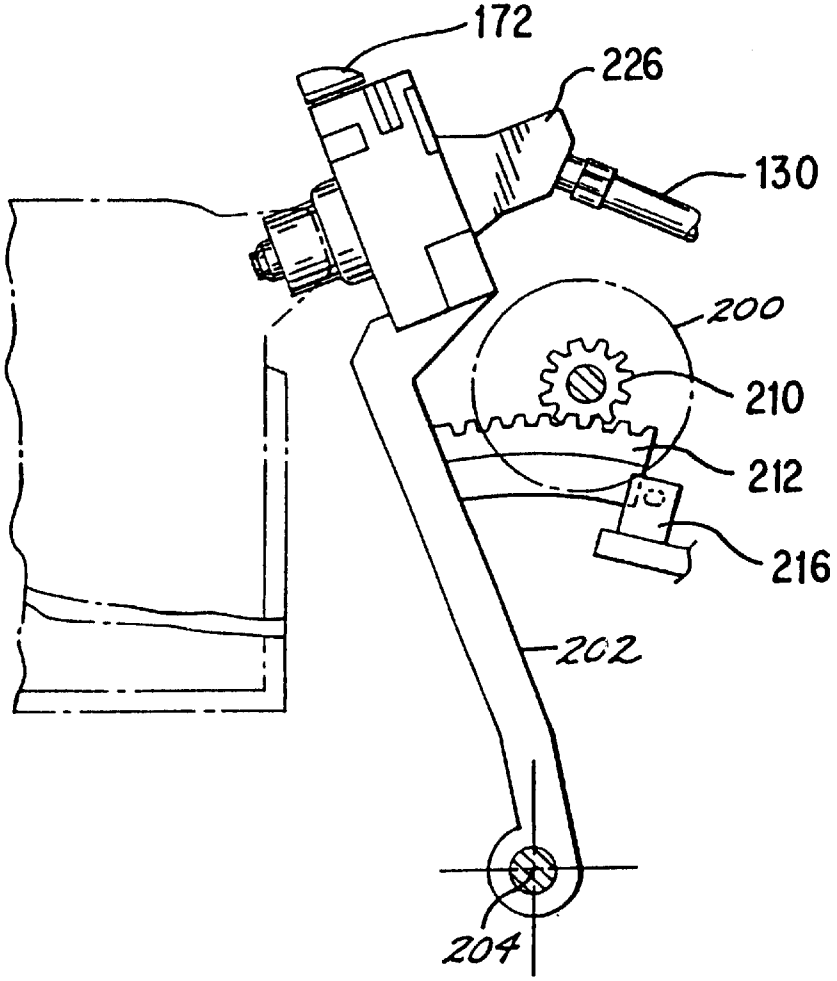
FIG. 13 is a detailed side view showing the mechanism for moving the valve structure in engaged position with a print cartridge.
Figure 12:
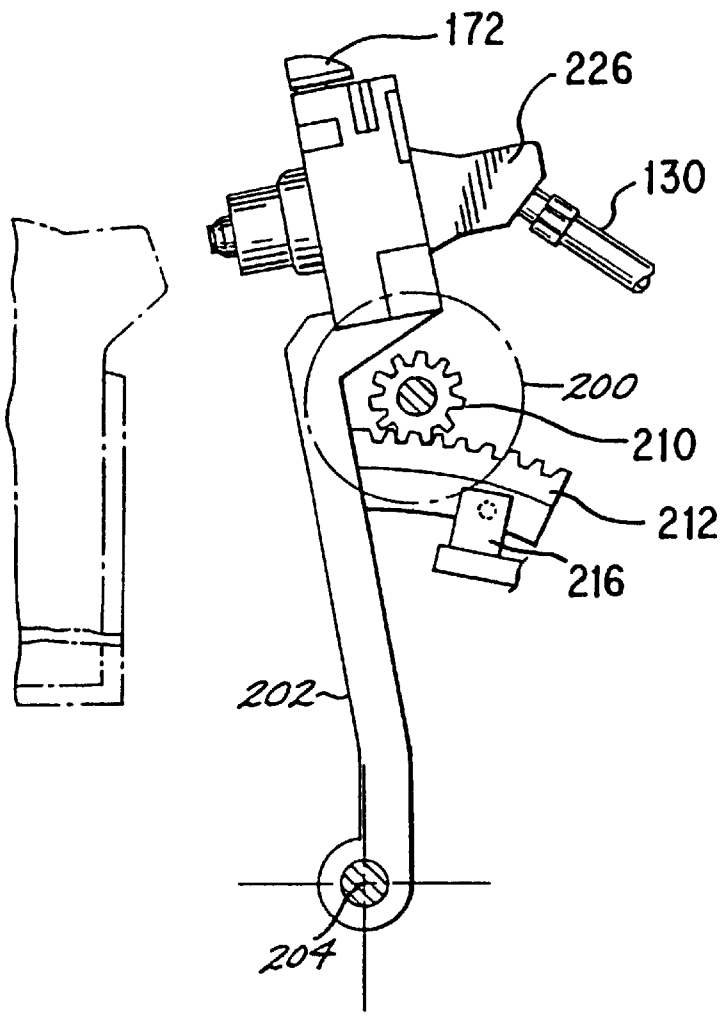
FIG. 12 is a detailed side view showing the mechanism for moving the valve structure in disengaged position with a print cartridge.

To perform a refill the carriage assembly so is moved to the refill station where the four off-carriage reservoirs 80–86 are connected to the corresponding print cartridges 70–76 via the shut-off valves 160–166. The connection of the reservoirs is accomplished by turning a stepper motor 200 that advances a lever 202 on which the valve structures and refill station housing 170 are mounted, as shown in FIGS. 3 and 12–13. A system suitable for moving the valves into and out of engagement with the refill ports is more fully described in co-pending application Ser. No. 08/805,861, filed Mar. 3, 1997 APPARATUS FOR PERIODIC AUTOMATED CONNECTION OF INK SUPPLY VALVES WITH MULTIPLE PRINTHEADS, by Ignacio Olazabal et al. While the valves are engaged in the refill ports of the print cartridges, ink is pulled into the print cartridge reservoir due to the slight vacuum pressure (back pressure) in it. This back pressure is known to decrease with increasing ink volume. This results in a self regulating refill process where, as more ink is introduced into the print cartridges, the back pressure decreases to a point where the print cartridge can no longer pull additional ink from the cartridge and the refill stops. The pressure at which the flow of ink stops is governed by the distance offsetting th print cartridge and the off-carriage reservoir. The farther below the print cartridge the reservoir is located, the greater the final pressure in the print cartridge and the lower the resulting volume of ink in the print cartridge internal reservoir.

Figure 16:
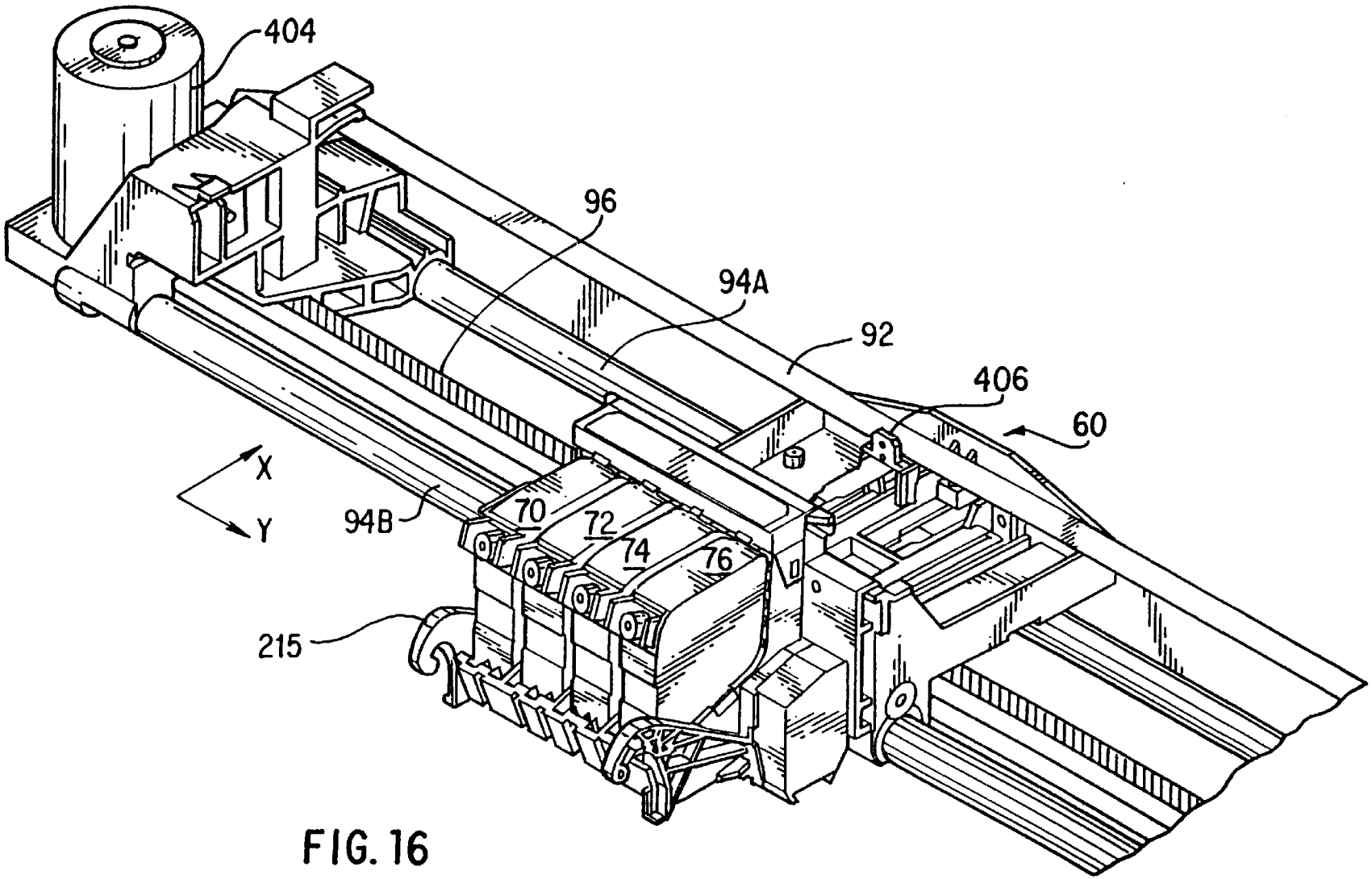
FIG. 16 is an isometric view of a carriage moving across a print zone.
Figure 17:
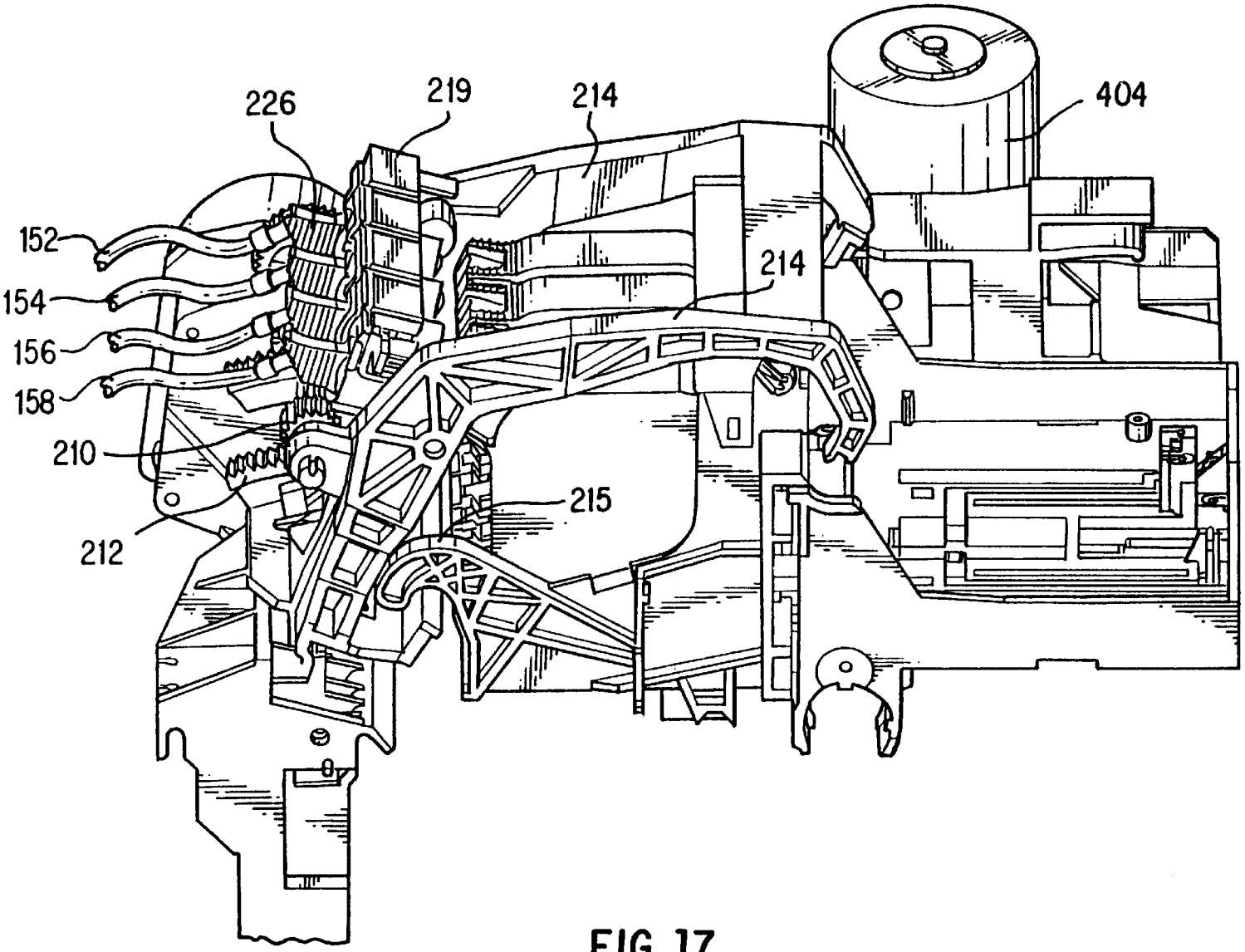
FIG. 17 shows the carriage of FIG. 16 in position at the refill station, with the valve structure in disengaged position.

As best shown in FIG. 16, the present invention does not require the specifications of the carriage to be redesigned due to the drag and interference that results from typical off-carriage ink systems where ink supply tubes remain constantly connected with the cartridges on the carriage during a printing operation. In contrast, the carriage shown in the drawings can move back and forth across the print zone without any supply tube connection whatsoever. Moreover, there is no need to account for the additional carriage mass that typically results from having a replaceable supplemental ink supply mounted directly on the carriage.

Additional details of the apparatus which provides the periodic connection/disconnection at the refill station between the print cartridge fill port and the off-carriage ink supply valve will now be described Referring to FIGS. 9, 12–13 and 17, a bracket holding the ink supply valves supports the motor 200 which turns gears 210 to move gear arms 212 back and forth between a position of engagement of the supply valves with their respective fill ports on the print cartridges, and a position of disengagement. Primary stabilizing arms 214 on the bracket as well as secondary stabilizing arms 215 on the carriage provide the necessary restraint required to minimize an undue stress on the cartridges which might otherwise displace their precise positioning in the carriage. The beginning and end points of the engagement/disengagement are defined by an optical sensor 216.

In the presently preferred embodiment of the invention, all four ink supply valves move together as a unit as they are held in fixed position in their apertures 218 by individual locking buttons 219 that allow each valve to be separately replaced whenever the expected life of the integrated IDS has expired for that particular color of ink. When replacement is required, an arrow-shaped orientation key 222 mates with a matching orientation slot 224 by easy manual manipulation through a valve handle 226.

Figure 14A:
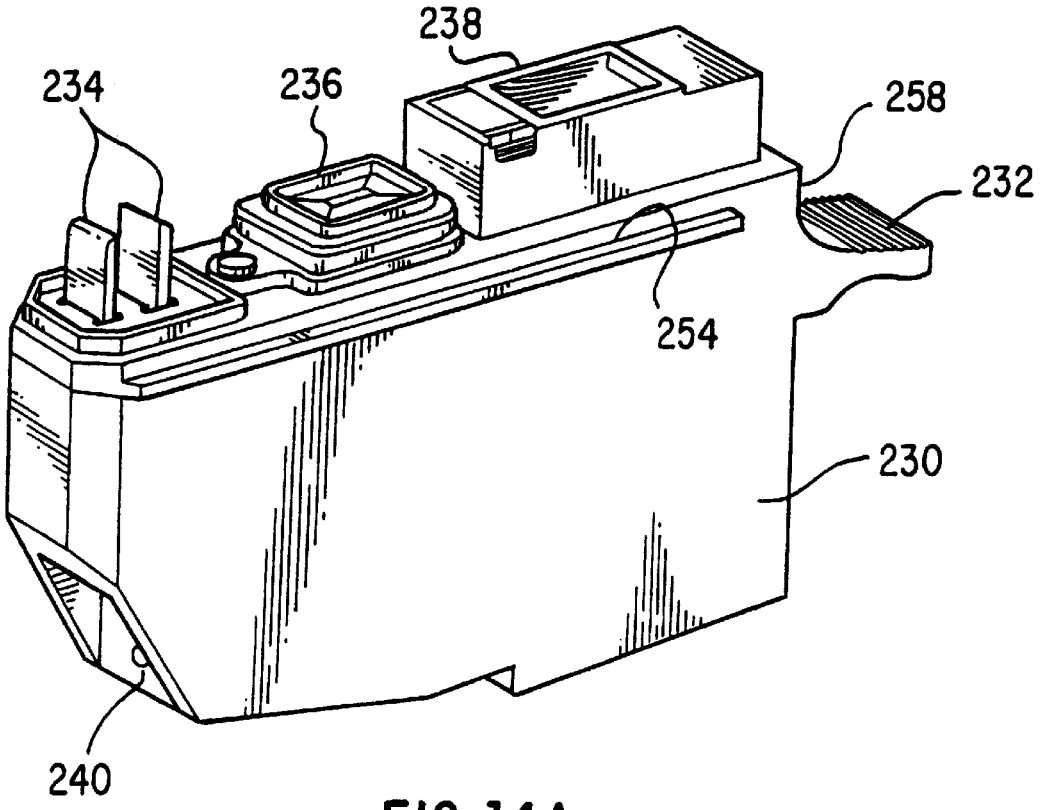
FIGS. 14A and 14B show an isometric and a side view, respectively of a service station module incorporating the present invention.
Figure 14B:
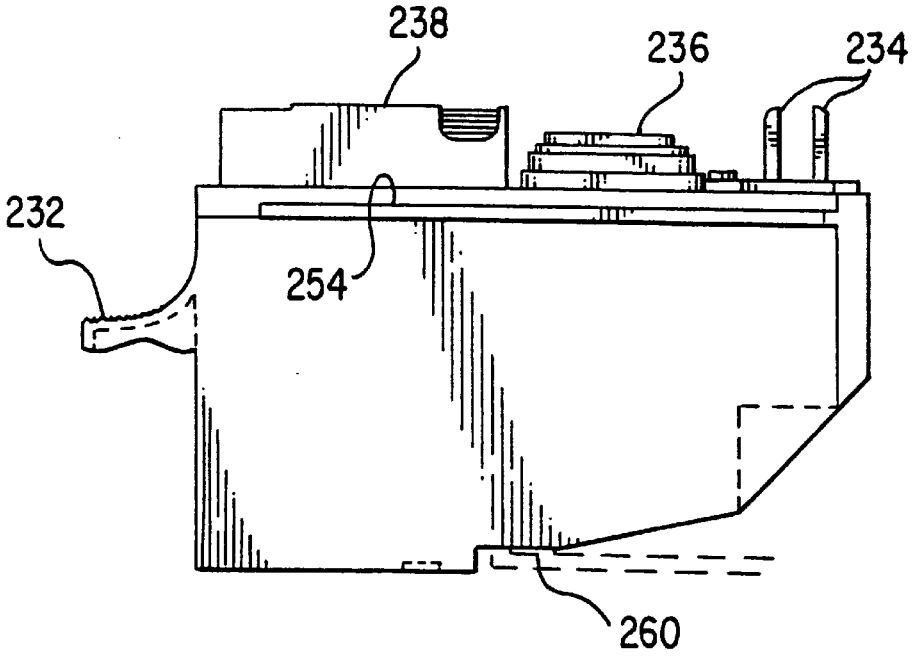
Figure 15:
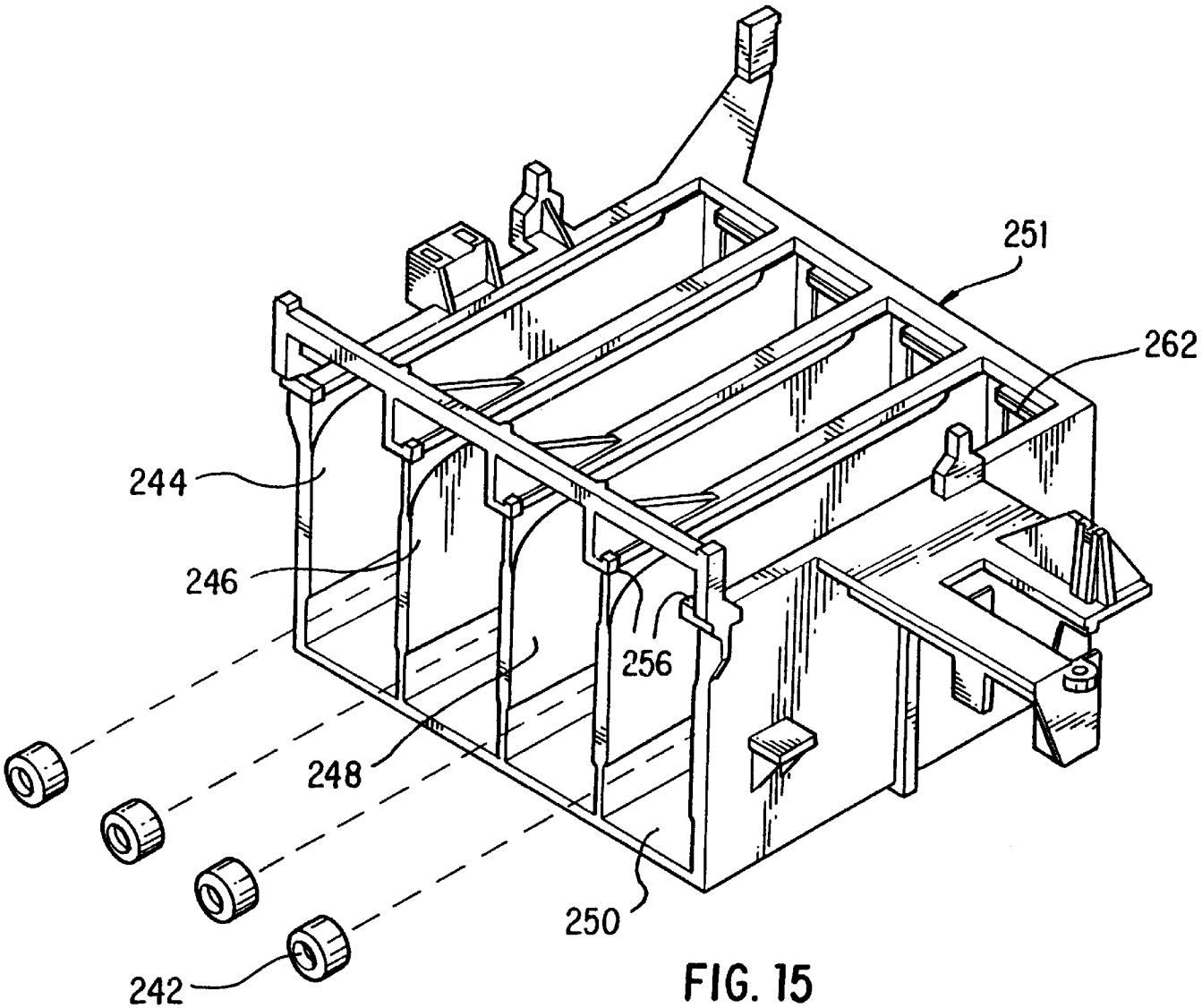
FIG. 15 is an isometric view of a carriage for removably mounting the service station module of FIGS. 14A–14B.

A unique narrowreplaceable service station module 230 for each color ink is an important part of the IDS. Referring to FIGS. 14A–14B and 15, this service station module includes a protruding handle 232 on one end, and a group of printhead servicing components which are combined together in a relatively small area on top of the module. At one end are dual wipers 234 and at the other a spittoon 238 with a nozzle plate cap 236 at an intermediate position. An external primer port 240 in the module is connected through an interior passage to the cap 236, and in the opposite direction through a circular seal 242 to a vacuum source. A service station carriage 251 includes separate slots 244, 246, 243, 250 for each service station module (also sometimes called a printhead cleaner).

A spring-loaded datum system provides for the service station module to be easily but precisely positioned in the service station carriage. Along a top portion of each slot is a z-datum ridge 252 which engages a corresponding datum ledge 254 along both top edges of the module. An upwardly biased spring arm 260 assures a tight fit along these datum surfaces. A horizontal positioning is provided in each slot by a pair of protruding corners which act as latches against matching stops 258 on the module. Although not required, a biasing arm 262 may be employed in a rear wall of each slot.

Figure 10:
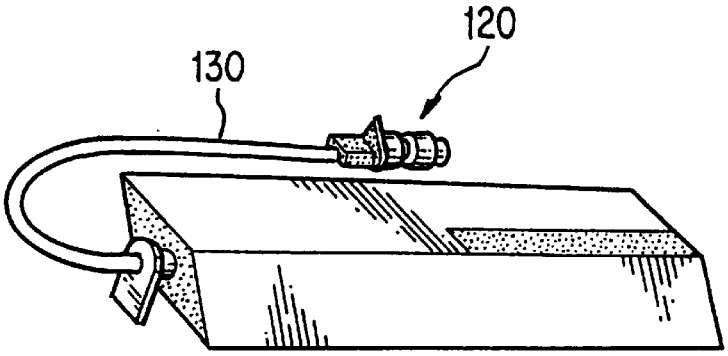
FIG. 10 shows an off-carriage ink supply module incorporating the present invention.
Figure 11:
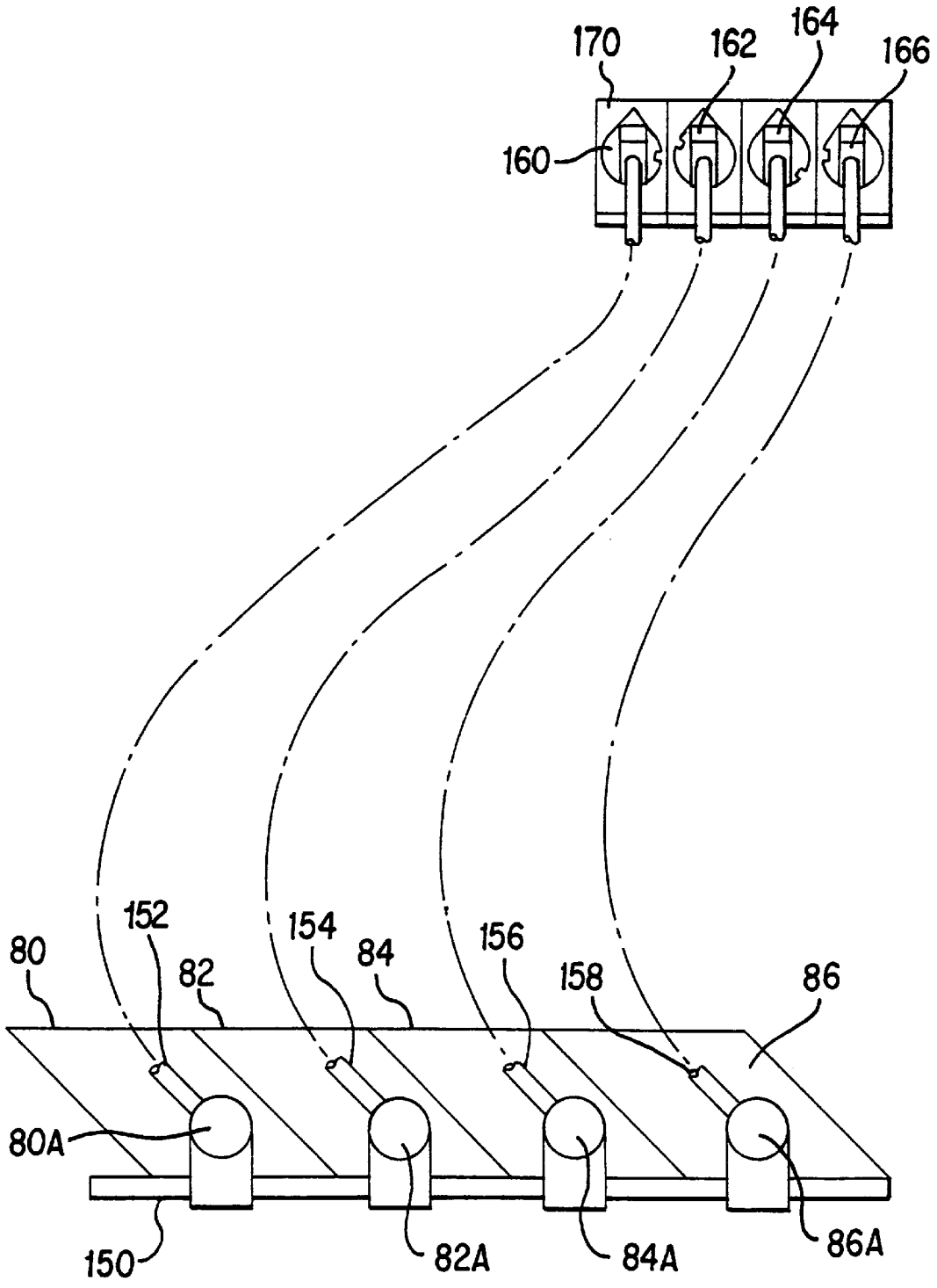
FIG. 11 is a schematic representation showing a plurality of off-carriage ink supply modules connected to the valve structure.

FIGS. 10 shows the basic exterior structure of an ink supply module before installation, and FIG. 11 shows how four such modules are grouped together on a refill platform on the printer with their valves manually installed on the valve bracked.

Figure 18A:
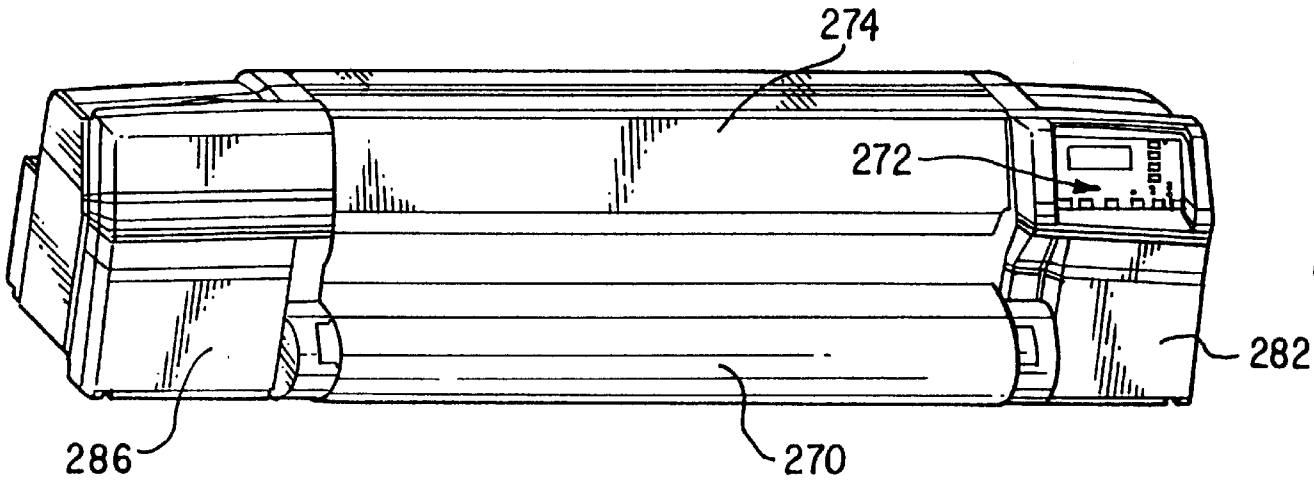
FIGS. 18A and 18B show the printer with the refill station and service station doors in closed and open positions, respectively.
Figure 18B:
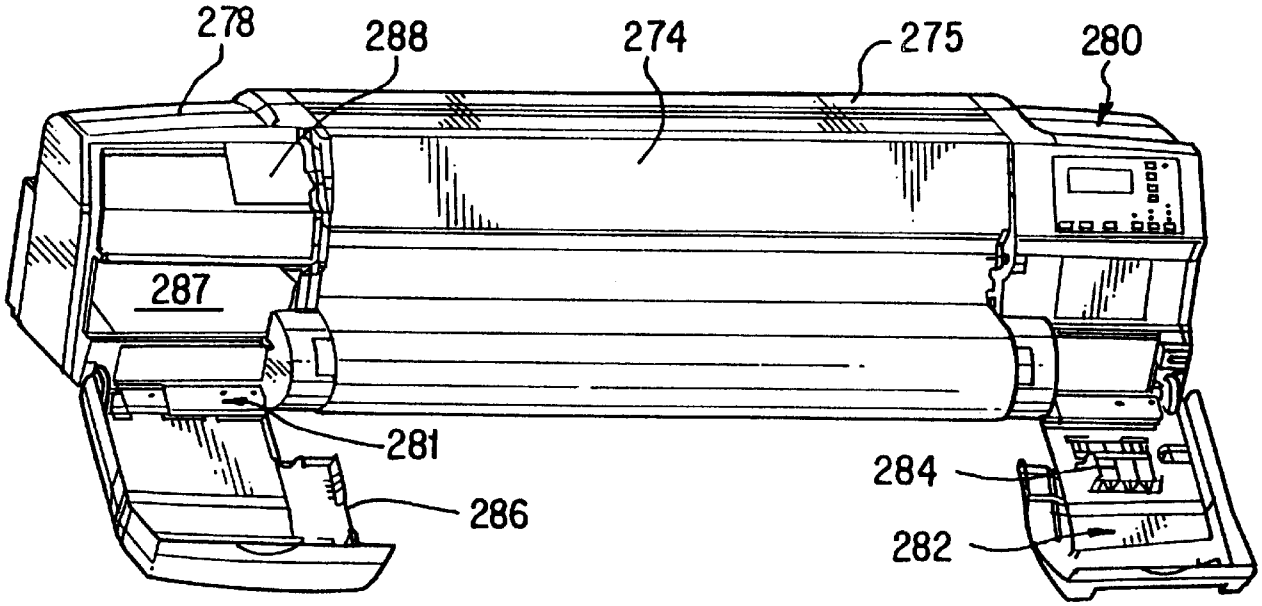

FIGS. 18A and 18B illustrate the accessability required for replacement of the three basic components parts of the IDS. The front of the printer unit typically includes a roll feed unit 270, a control panel 272 and a print zone access door 274 adjacent an elongated frame member 275. The service station is located at the right end of the carriage scan axis, and a refill station 278 at the opposite end. Simple friction latches such as indicated at 280 are provided to assure proper closure of doors which are mounted on pivot hinges such as 281. A pusher plate 284 contacts and helps to position any incompletely mounted service station modules upon closure of a service station access door 282. A similar door 286 closes off the refill station during normal operation of the printer and during replacement operations. The refill station includes space 287 for an ink supply platform, and an access hole 288 from the platform to carriage-mounted printheads.

Figure 19:
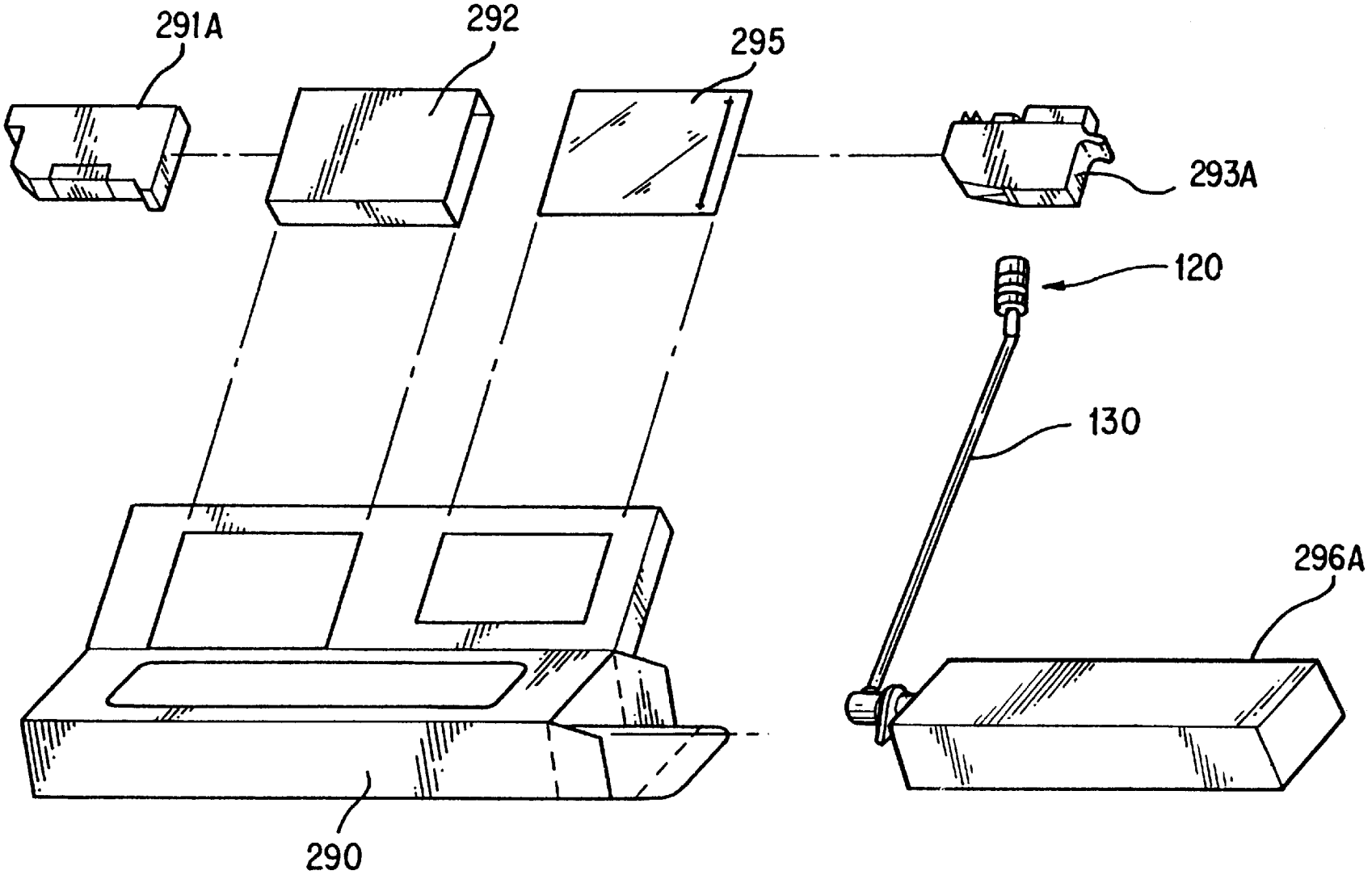
FIG. 19 is an exploded schematic view showing the integrated ink delivery system component of the invention (print cartridge, ink supply module and service station module) incorporated into a single package.
Figure 20:
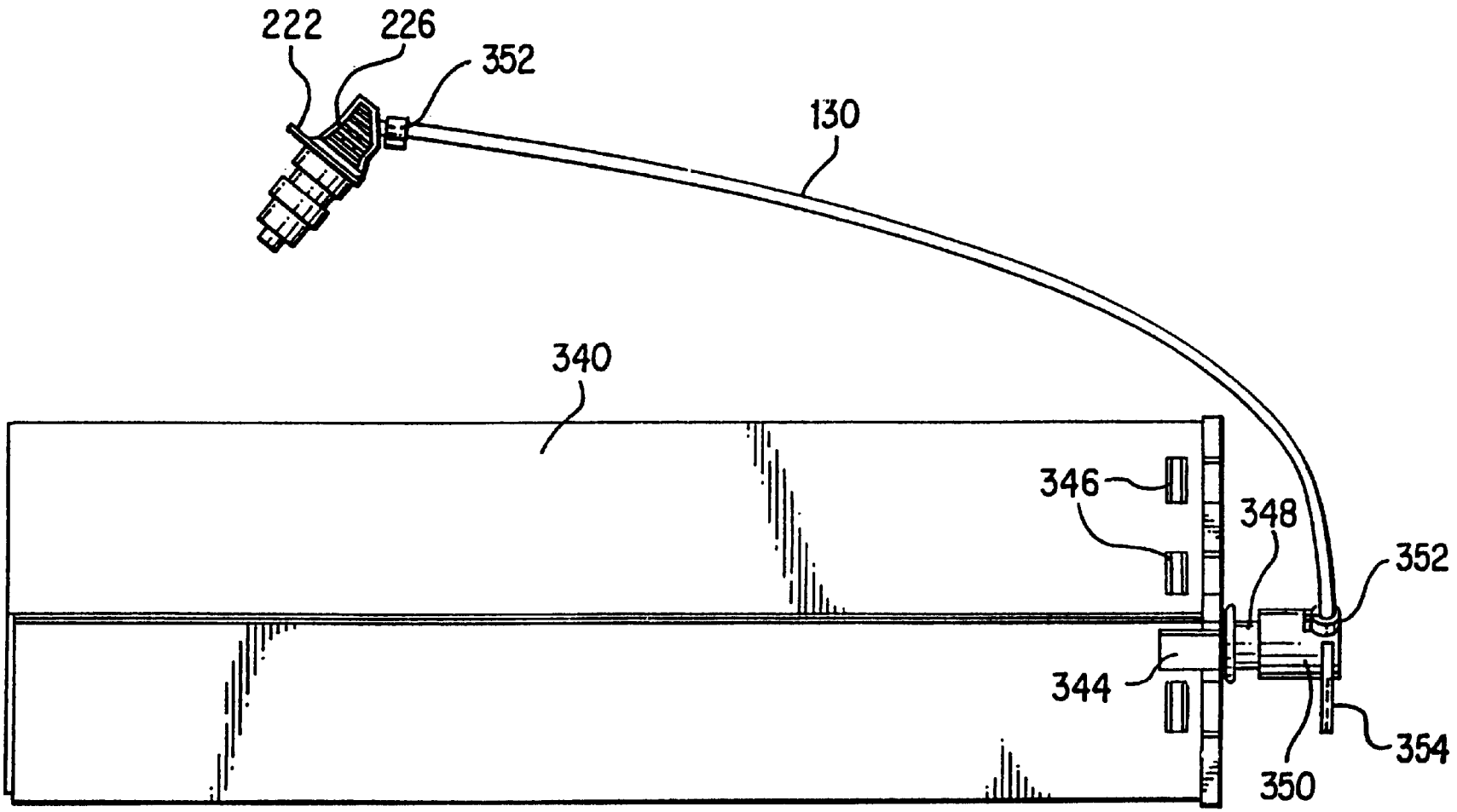
FIG. 20 is a bottom view of the off-carriage ink supply module of FIG. 10.

Additional details relating to the unique shape and mounting technique for the ink supply module is shown in FIG. 19. An outer enclosure 340 is formed from a symmetrical cardboard carton which is partially distorted to form a diamond shaped cross-sectional enclosure for housing a collapsible ink bag 356. An important feature is a hard plastic diamond-shaped end plate 342 which has tabs 344 for engaging the adjoining edges of the outer enclosure. Cutouts 346 are also provided in the enclosure to match projections from the end plate. An adaptor 348 extends from an end outlet through an ink supply hole which is off-center to facility depletion of ink from the ink supply bag when it is held inside of the enclosure.

An installation procedure will now be described in conjunction with FIGS. 19, 29–31. An ink delivery system is preferably packaged as a unit in a carton 290 which holds a new print cartridge 291A, a new service station module 293A in a plastic storage bag 295, and a new ink supply module 296A. As shown in the self-explanatory sequence of drawings of FIG. 29, an old print cartridge 291B is easily removed and replaced with a new one 291A, after actuating a button on the control panel 272 and opening the print zone access door 274 as shown by arrow 300. As shown in the self-explanatory sequence of drawings of FIG. 30, a depleted ink supply module 296B is removed without difficulty by first opening the ink door 286 as shown by arrow 302, then pushing down on the lock button as shown by arrow 304 and at the same time pulling out the valve as shown by arrow 306 and then removing the ink supply module 296B from the printer as shown by arrow 308. The depleted ink module 296B can then be replaced with a new ink supply module A and then the ink door 286 is closed. Finally as shown in the self-explanatory sequence of drawings of FIG. 31, after the service station access door 282 is opened, a user can push down on the handle in the direction shown by arrow 310 thereby dislodging an old service station module 293B, and then pull it out all the way as indicated by arrow 312, followed by installation of a new service station module 293A.

Additional details of the ink supply module include an adaptor 348 which connects tie bag to and end-connect junction unit 350 which communicates to one end of a tube through a connection held tight by a metal band 352. A handle 354 is provided on the junction unit 350.

The collapsible bag 365 has a narrow seam 357 around three edges of the bag which is flat when empty. A wider seam 358 provides a secure connection to the adaptor 348. The unique positioning of a somewhat full bag is facilitated by a diamond-shaped rear end 360 of the enclosure which has a direct connection to one side of the enclosure along a joint 361 and which has a bent insert 362 for attachment. Color coding of the ink supply module is shown on the all-dark areas of FIG. 10, which incidentally matches a similar solid color coding around the orientation slot 224 of the valve bracket.

The ink refill station is shown in more detail in FIGS. 21–27. A base portion 364 supports upstanding angled partitions 366 which define separate slots or compartments 368 for each different ink supply enclosure to hold them in a unique nested fashion with partial overlapping in order to obtain the advantage of a flattened collapsible ink supply reservoir without the usual wasted space. A front lip provides tactile feedback to a user that an installation has been completed, while also holding they reservoirs in secure position during a refill sequence. A lower housing is also provided to house the motor mechanisms for raising or lowering the ink supply platform as needed. An upper housing 372 is provided to partially cover the compartments. This upper housing which also provides the previously mentioned partitions is attached to front holes 373 through tabs 374, and to back holes 375 through back tabs 376, supplemented by the spring-like gripping action of back hooks 377.

Accordingly it will be appreciated by those skilled in the art that the basic features of the unique take-a-gulp ink replenishment system of the present invention provides a unique but relatively simple way of providing for unattended printing through automated ink replenishment. Furthermore, all ink-related components can be replaced for a particularly color of ink by a user, without the need of special tools and without the need of calling a specialized service person. And efficient use of the ink supply station space allows easy accessability as well as precise dispensing of ink from the unique nesting capabilities of the ink module enclosures on the ink refill platform.

Figure 21:
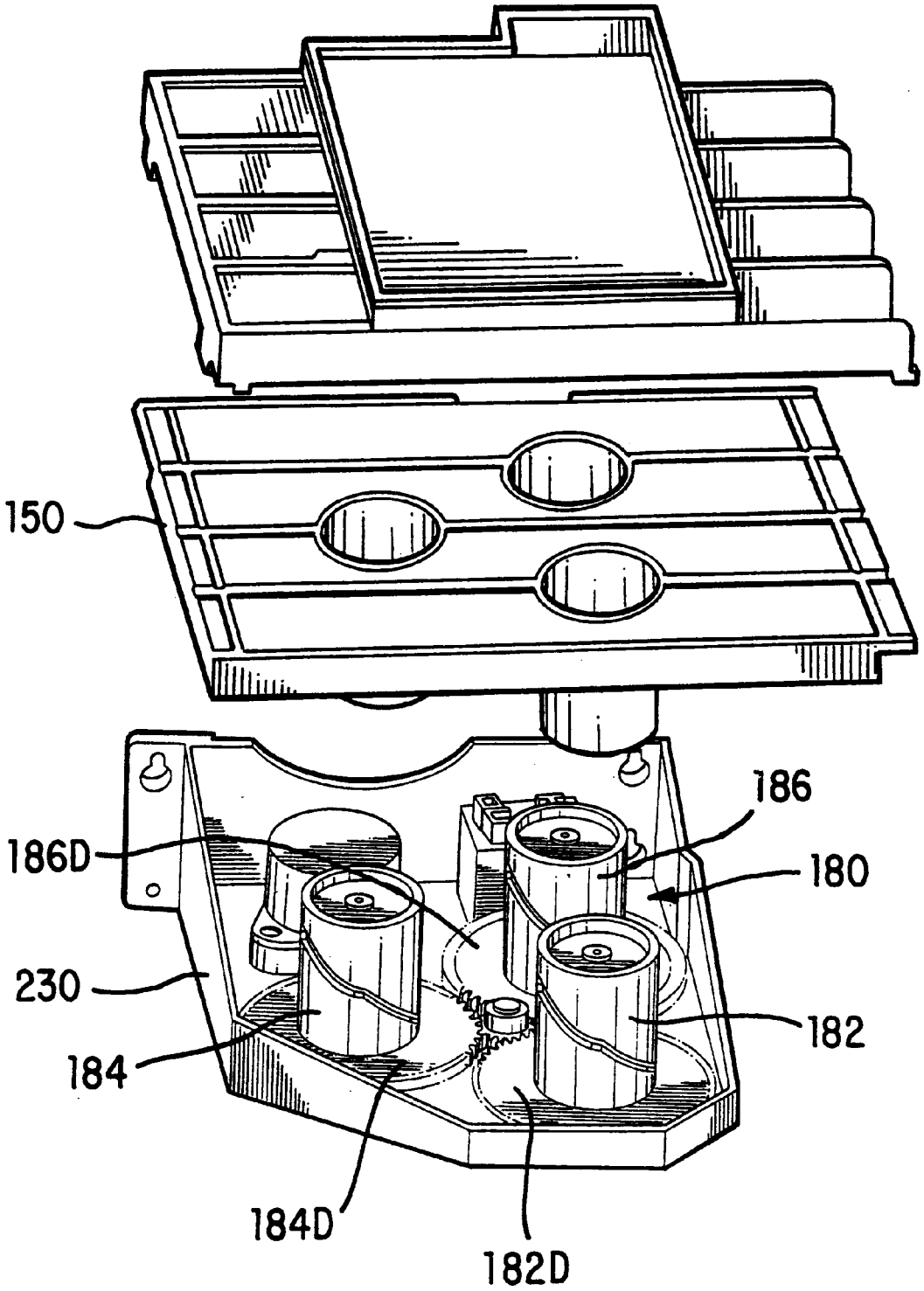
FIG. 21 is an isometric exploded view of the elevator platform structure and cam system.
Figure 22:
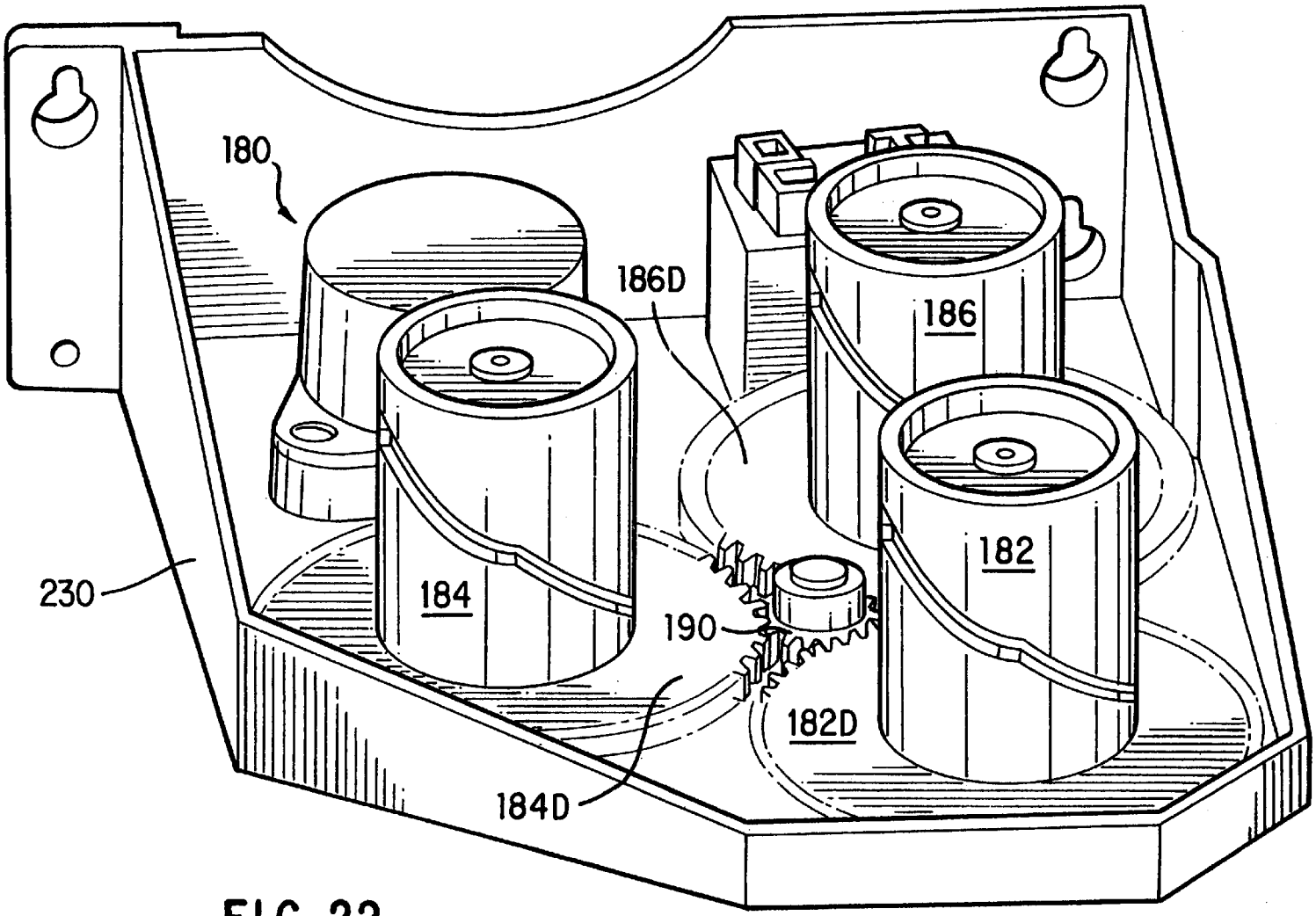
FIG. 22 is an enlarged isometric view of the cam system of the elevator drive system.
Figure 23:
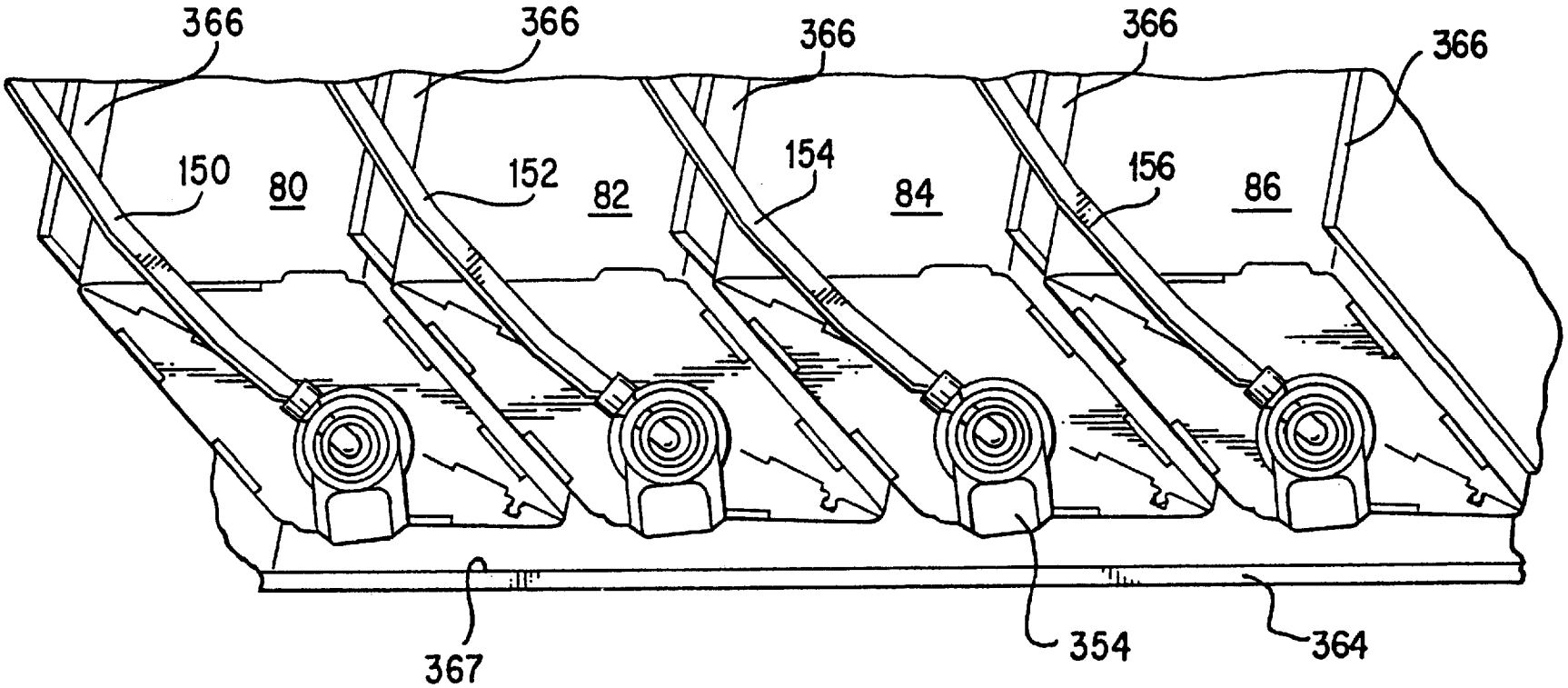
FIG. 23 is an isometric view of the ink refill station platform and ink supply compartments.
Figure 24:
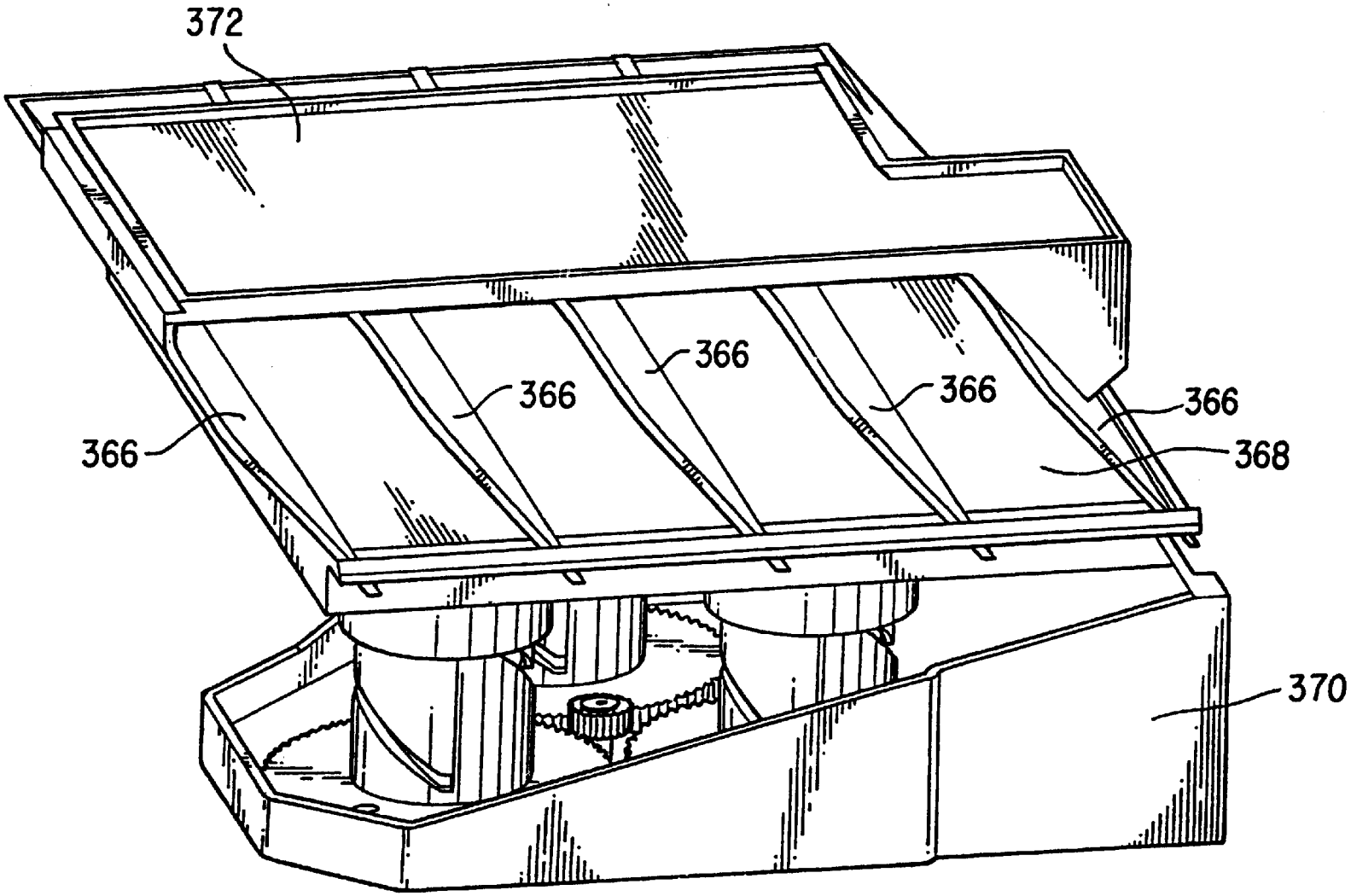
FIG. 24 is an isometric view of the motor drive, cam system and ink refill station platform and ink supply compartments.
Figure 25:
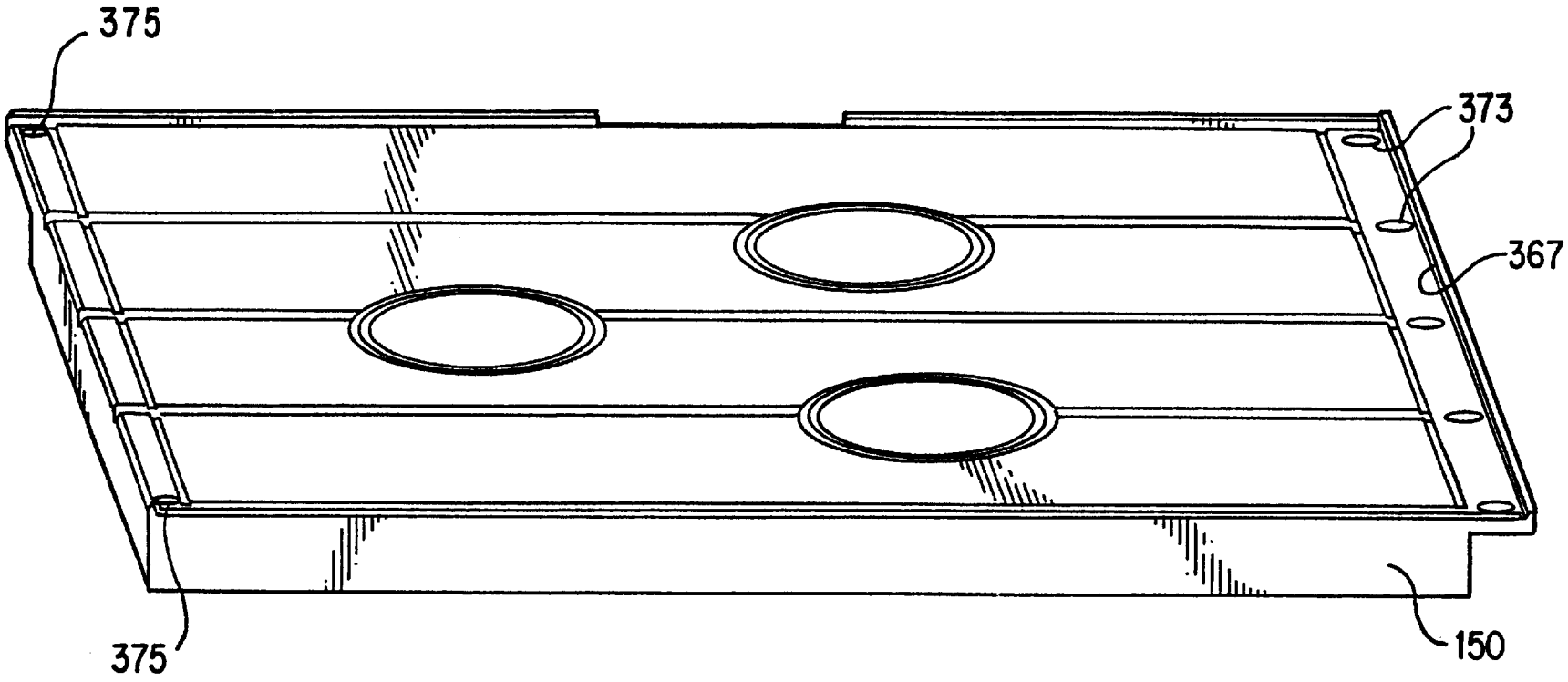
FIG. 25 is an isometric view of the refill platform in isolation.
Figure 26:
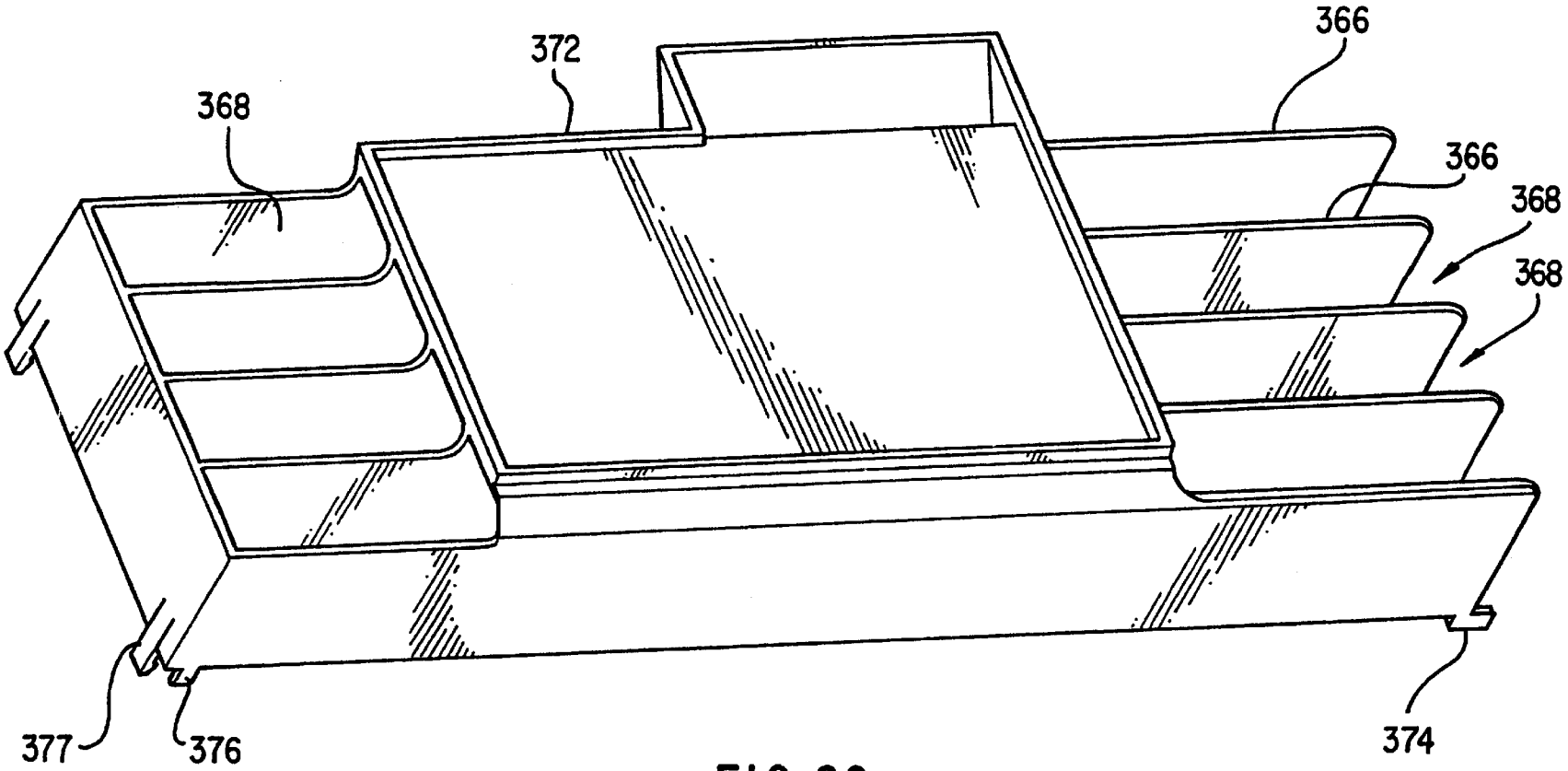
FIG. 26 is an isometric view of the ink supply compartment structure in isolation.
Figure 27:
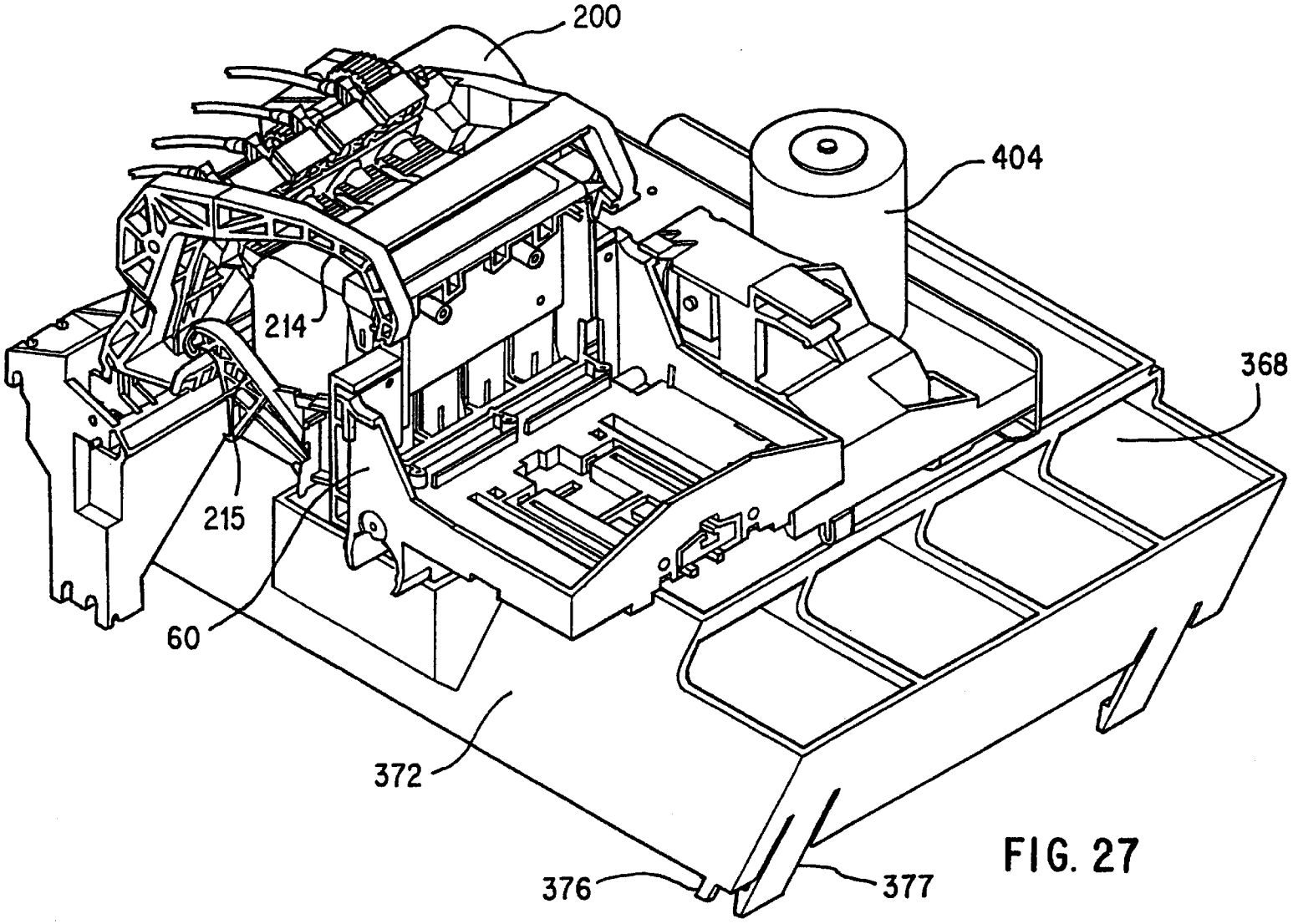
FIG. 27 sows a carriage in position above the refill platform with the ink supply modules installed and with the valve structure in disengaged position.

FIG. 21 is an isometric exploded view of the plate 230, the refill platform 150 and the cam system 180. The cams 182, 184, 186, with the meshing of cam gears 182D, 184D and 186D with gear 190C, are shown in this view. FIG. 22 is an enlarged isometric view of the cam system 180 and plate 230, also showing the meshing of cam gears 182D, 184D, 186D with gear 190C.

FIGS. 23–27 show the refill station in more detail, with platform 150 supporting upstanding angled partitions 366 which define separate slots or compartments 368 for each different ink supply enclosure to hold them in nested fashion with partial overlapping in order to obtain the advantage of a flattened collapsible ink supply reservoir. The upper housing 372 is provided to partially cover the compartments, and is attached to the platform 150 by tabs 374, 376 received in holes 373, 375.

Figure 28:
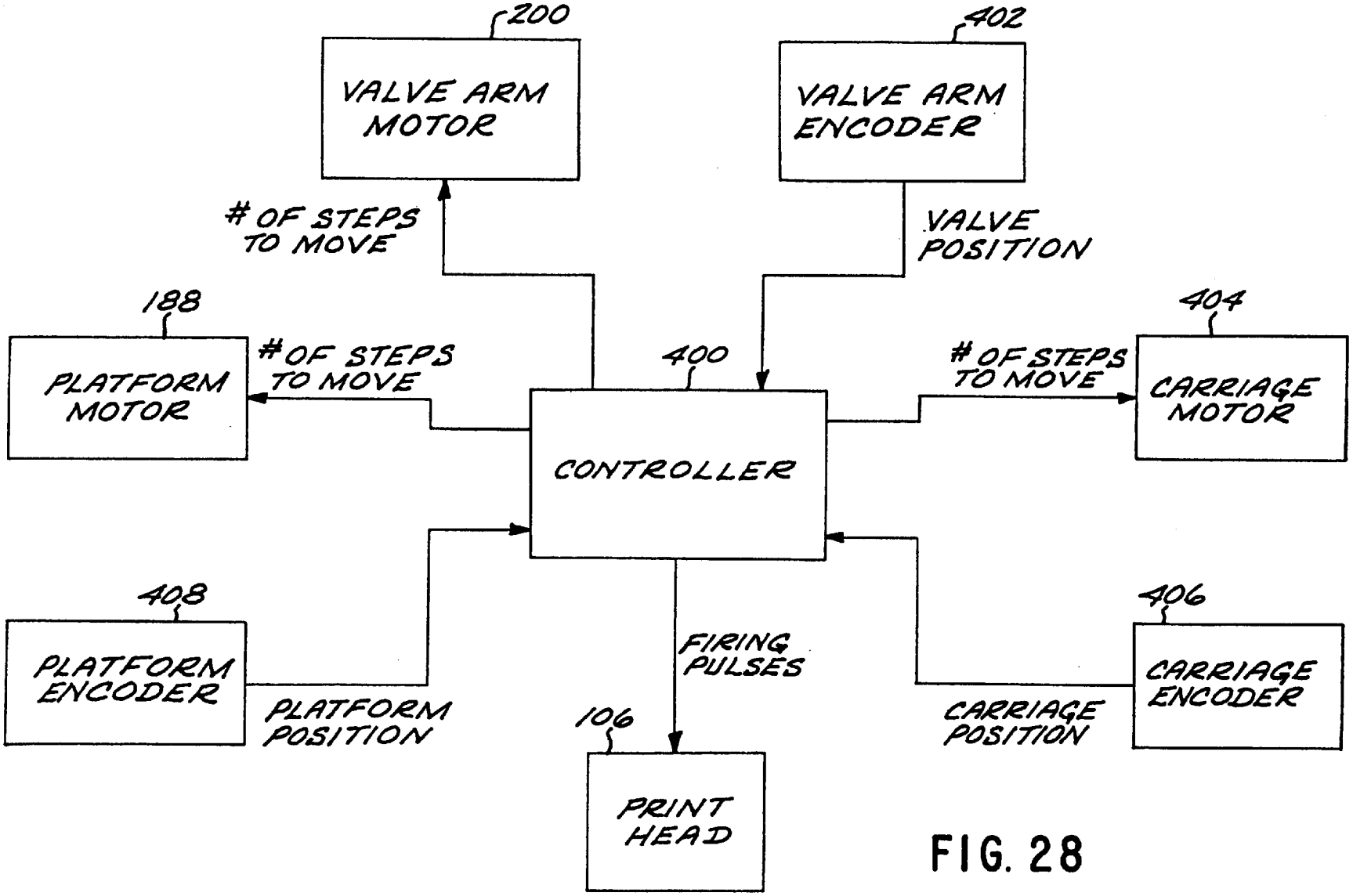
FIG. 28 is a simplified functional block diagram of the system controller and controlled elements of the printing system of FIG. 1.
Figure 29:
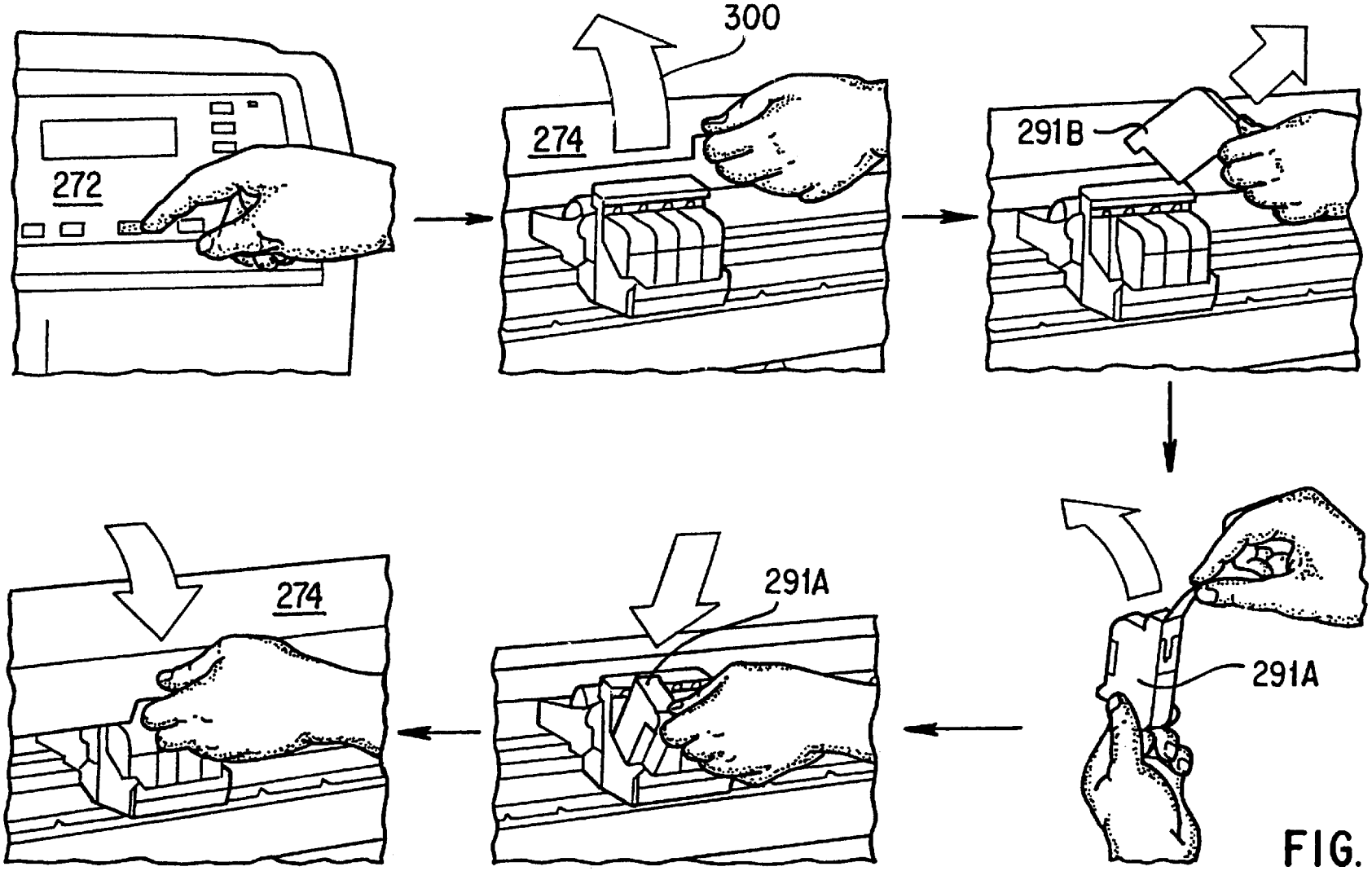
FIG. 29 shows six exemplary steps for replacing the print cartridge of the present invention.
Figure 30:
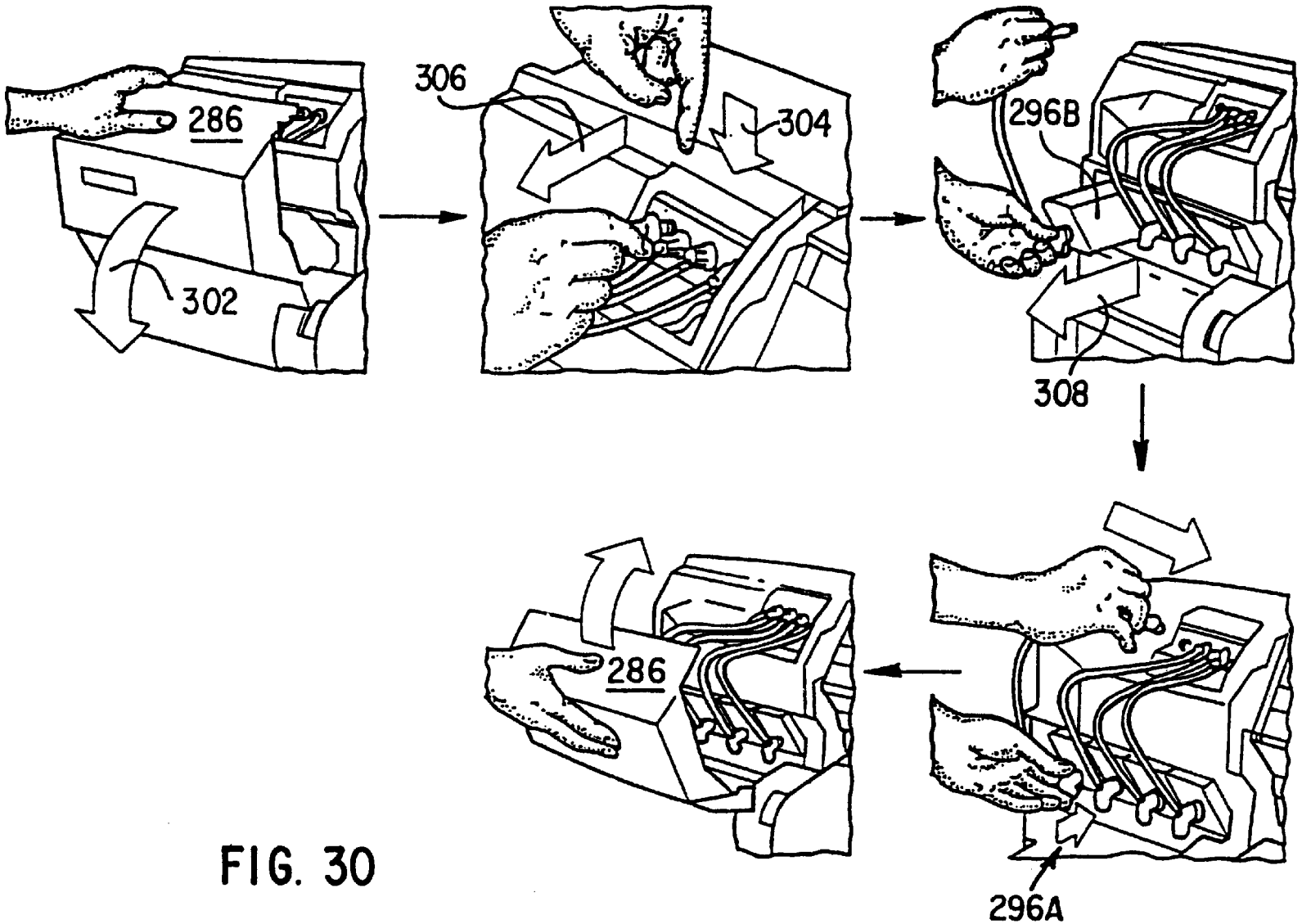
FIG. 30 shows five exemplary steps for replacing the ink supply module of the present invention.
Figure 31:
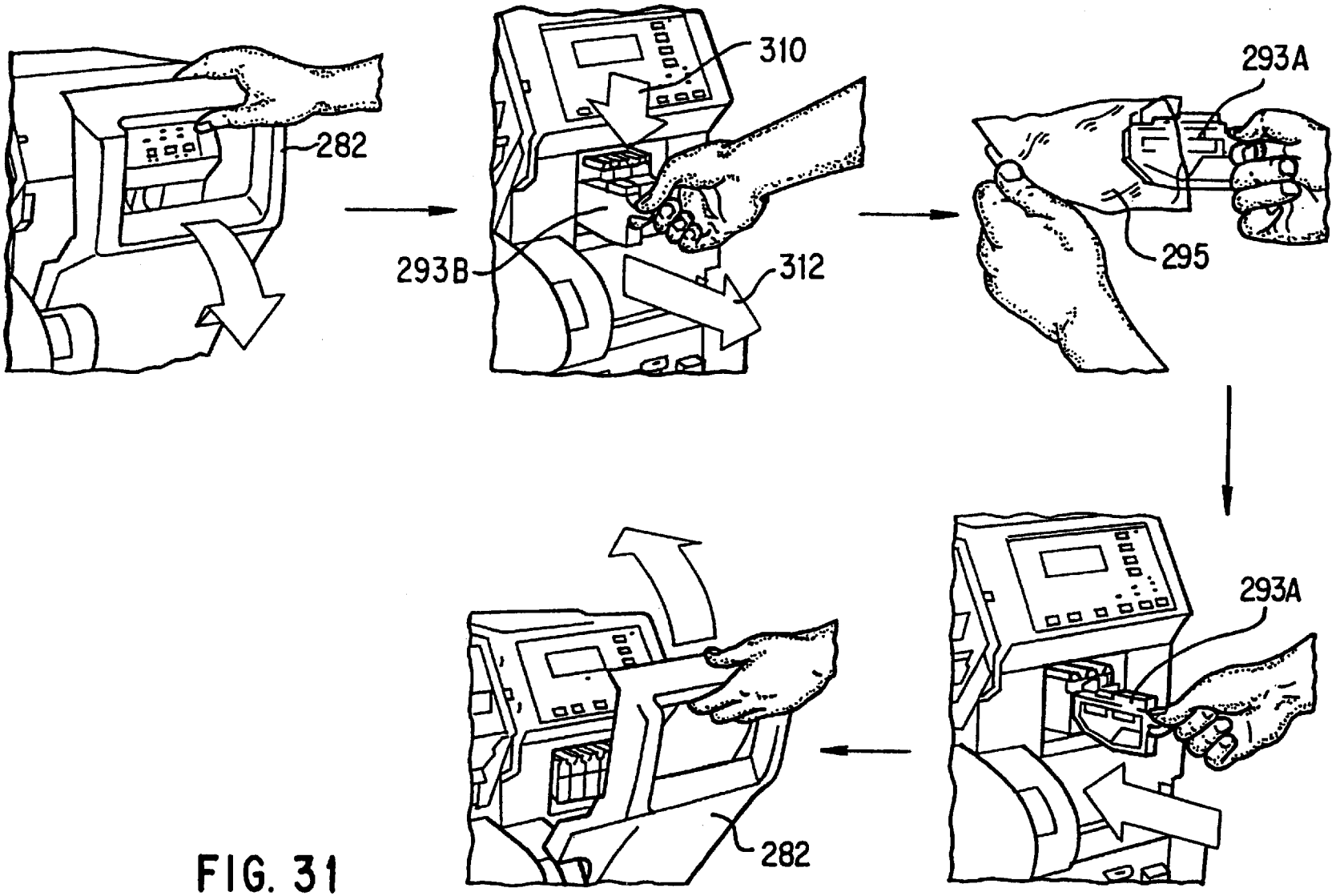
FIG. 31 shows five exemplary steps for replacing the serive station module of the present invention.

FIG. 28 is a simplified functional block diagram showing the system controller 400 and various elements of the drive and control system. The controller 400 provides firing impulses to the firing chamber resistors of the printhead 106, and counts the number of drops fired for each color. The controller controls the carriage stepper drive motor 404, receiving carriage position data from a carriage encoder sensor 406. The controller also issues drive signals to the platform motor 188 and valve arm motor 200, receiving platform and valve position data from encoders 408 and 402.

While a preferred embodiment of the invention has been shown and described, it will be appreciated by those skilled in the art that various modifications can be made without departing from the spirit and scope of the invention as defined by the following claims.

We claim as our invention:

1. An inkjet printing system comprising:

a printer frame;

a scanning carriage mounted on said frame for traversing back and forth along a scan axis through a print zone;

at least one printhead mounted on said carriage, and having a sealed printhead ink reservoir and a normally closed inlet valve in fluid communication with the printhead ink reservoir for receiving ink;

an ink replenishment station located on said frame at one end of said scan axis, said ink replenishment station including an ink supply;

a normally closed supply valve in communication with said ink supply capable of periodic connection to said inlet valve; and an automated motorized mechanism for moving the supply valve into engagement with the inlet valve to provide a fluid path for ink to flow from the ink supply to the printhead ink reservoir.

2. The printing system of claim 1 wherein said ink supply includes an enclosed container having a collapsible bag for holding ink.

3. The printing system of claim 2 wherein said ink replenishment station further includes ink inside of said bag.

4. The printing system of claim 2 wherein said ink replenishment station further includes a platform for removably supporting said container.

5. The printing system of claim 4 wherein said ink replenishment station further includes a plurality of compartments for removably holding multiple containers, respectively.

6. The printing system of claim 5 wherein said compartments each include a front opening for receiving one of said containers.

7. The printing system of claim 6 wherein said compartments are separated from each other by an upstanding wall.

8. The printing system of claim 6 wherein said compartments each include a lower ledge to engage a front portion of said container to hold said container in said compartment.

9. The printing system of claim 6 which further includes a plurality of containers, each having a tube connecting to said supply valve, said tube extending forwardly out of said front opening of said compartment when said container is installed on said platform.

10. The printing system of claim 9 wherein at least two tubes of two different containers have different lengths.

11. The system of claim 1, wherein said printhead reservoir is a negative pressure reservoir for holding ink under vacuum pressure, and wherein during an ink replenishment operation when said supply valve is engaged with said inlet valve, ink flows into the printhead ink reservoir only as a result of vacuum pressure present in the printhead reservoir.

12. The system of claim 1 further comprising a supply of liquid ink within said printhead ink reservoir.

13. An inkjet printing system comprising:

a printer frame;

a scanning carriage mounted on said frame for traversing back and forth along a scan axis through a print zone;

a plurality of printheads mounted on said carriage, each printhead having a sealed printhead reservoir holding a different color of ink and a normally closed inlet valve;

a service station located at one end of said scan axis for storing said carriage and said printheads when the printer is not in use;

an ink replenishment station located at another opposite end of said scan axis for storing auxiliary supplies of ink for said printheads, including an automated motorized mechanism for positioning said carriage and said printheads and intermittently making and disconnecting a fluid interconnection through said respective inlet valves from said auxiliary supplies of ink for periodic ink refilling operations when said printheads are not applying ink to media.

14. The printing system of claim 13 which includes a front-accessible compartment in said ink replenishment station for removably holding a container of ink.

15. The printing system of claim 14 which includes a manually operative door for preventing access to said container of ink during normal operation of the printing system.

16. The printing system of claim 14 wherein said door prevents access to said printheads on said carriage during a refilling operation.

17. The printing system of claim 14 wherein said door prevents access to said ink containers during a refilling operation.

18. The printing system of claim 14 wherein said front accessible compartment for said ink container is located below said carriage during a refilling operation.

19. The printing system of claim 14 wherein said ink supply includes a rigid container holding a collapsible bag of ink.

20. A method of ink replenishment of inkjet printheads without removing the printheads from a scanning carriage, comprising:

storing an auxiliary supply of ink in a collapsible bag for each of the printheads;

providing an outlet tube at one end of said bag;

removably placing said bag on a printer frame platform with the outlet tube extending outwardly from a front of a printer frame;

providing a protective door to prevent access to said bag during a refilling operation; and automatically and periodically connecting said ink bag with said printheads to transfer ink from the bag to a printhead reservoir, and subsequently disconnecting said bags from said printheads upon completion of said refilling operation while said protective door remains closed to prevent any manual intervention while the carriage is parked in an ink replenishment station outside of a print zone.

21. The method of claim 20 including providing a plurality of different printheads on the carriage, and providing a separate container of ink on the platform for each printhead, respectively.

22. The method of claim 20 which further includes providing a protective door to prevent access to the printheads during a refilling operation.

23. The method of claim 20 further comprising:

providing a supply of liquid ink in the printhead reservoir.

24. The method of claim 20 wherein said providing said protective door includes:

maintaining the door in a closed position while said ink bags are connected to the printheads during refilling operations.

* * * * *